US008212749B2

(12) United States Patent
Cho et al.

(10) Patent No.: US 8,212,749 B2
(45) Date of Patent: Jul. 3, 2012

(54) AMOLED DRIVE CIRCUIT USING TRANSIENT CURRENT FEEDBACK AND ACTIVE MATRIX DRIVING METHOD USING THE SAME

(75) Inventors: Gyu-Hyeong Cho, Chungcheongnam-do (KR); Young-Suk Son, Hwaseong-si (KR); Sang-Kyung Kim, Daejeon-si (KR); Jin-Yong Jeon, Daegu (KR); Gun-Ho Lee, Gyeonggi-do (KR)

(73) Assignee: Korea Advanced Institute of Science and Technology, Daejeon-si (KR)

( * ) Notice: Subject to any disclaimer, the term of this patent is extended or adjusted under 35 U.S.C. 154(b) by 988 days.

(21) Appl. No.: 11/693,819

(22) Filed: Mar. 30, 2007

(65) Prior Publication Data

US 2008/0238327 A1 Oct. 2, 2008

(51) Int. Cl.
*G09G 3/32* (2006.01)

(52) U.S. Cl. ..... 345/82; 345/76; 345/84; 345/204; 315/169.3; 313/463

(58) Field of Classification Search ..... 345/72–93, 345/204, 205, 214; 315/169.1–169.3; 313/463
See application file for complete search history.

(56) References Cited

U.S. PATENT DOCUMENTS

2006/0118700 A1* 6/2006 Chaussy et al. ..... 250/214.1
2006/0119551 A1* 6/2006 Chaussy et al. ..... 345/76

* cited by examiner

*Primary Examiner* — Lun-Yi Lao
*Assistant Examiner* — Kelly B Hegarty
(74) *Attorney, Agent, or Firm* — Bachman & LaPointe, P.C.

(57) ABSTRACT

Disclosed herein is an Active Matrix Organic Light-Emitting-Diode (AMOLED) drive circuit using transient current feedback. The AMOLED drive circuit includes a current Digital-to-Analog Converter (DAC), a data line drive transistor, a constant current source, a variable current source, a differential amplifier, and a transient charging current control unit. The DAC generates current corresponding to input digital data. The data line drive transistor is configured such that the drain terminal thereof is connected to the output node of the current DAC. The constant current source is connected between the source terminal of the data line drive transistor and a ground. The variable current source is connected between both the output node of the current DAC and the drain terminal of the drive transistor, and a voltage source. The differential amplifier is configured to input the output voltage thereof to the gate terminal of the drive transistor. The transient charging current control unit is configured to increase or decrease the bias current of the variable current source depending on variation in the voltage of the output node of the current DAC.

39 Claims, 18 Drawing Sheets

PRIOR ART
[Figure 1]
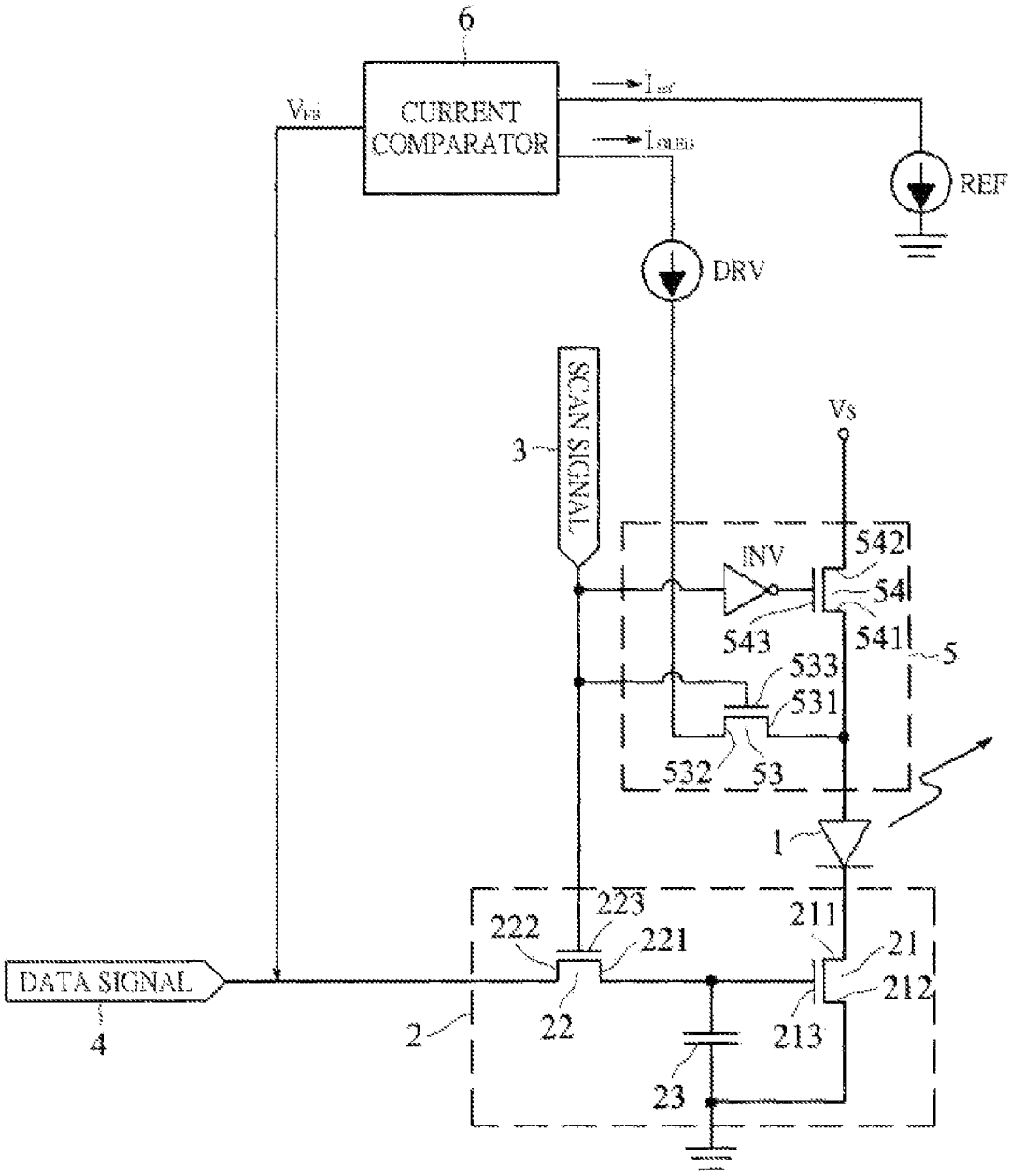

PRIOR ART
[Figure 2]
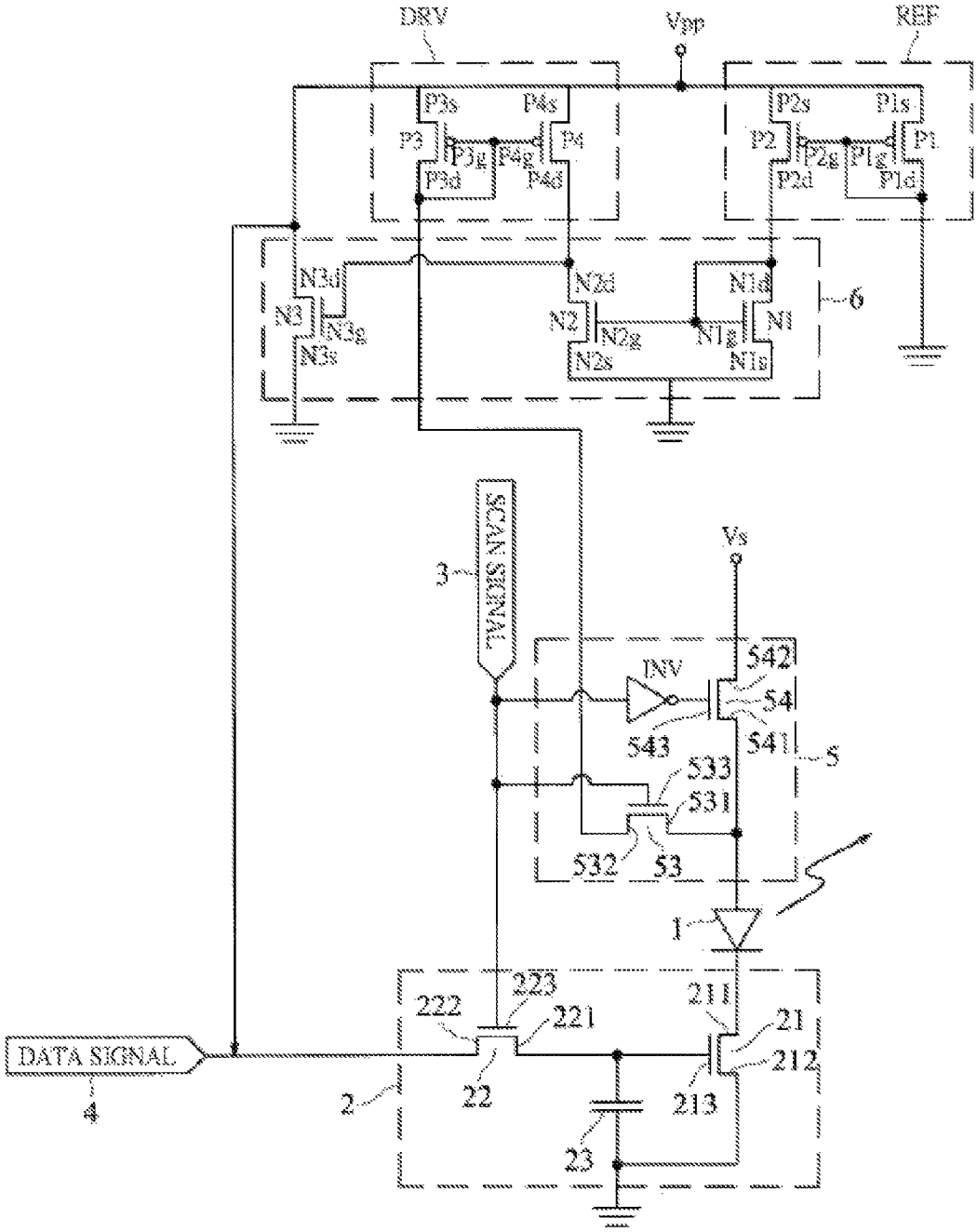

PRIOR ART
[Figure 3]
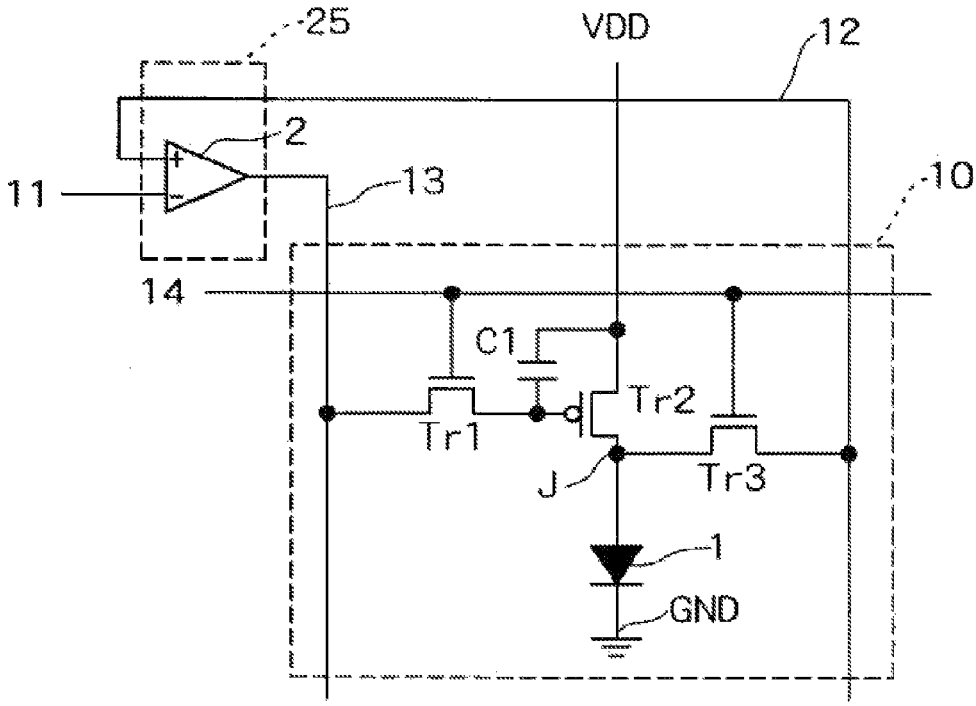

PRIOR ART
[Figure 4]
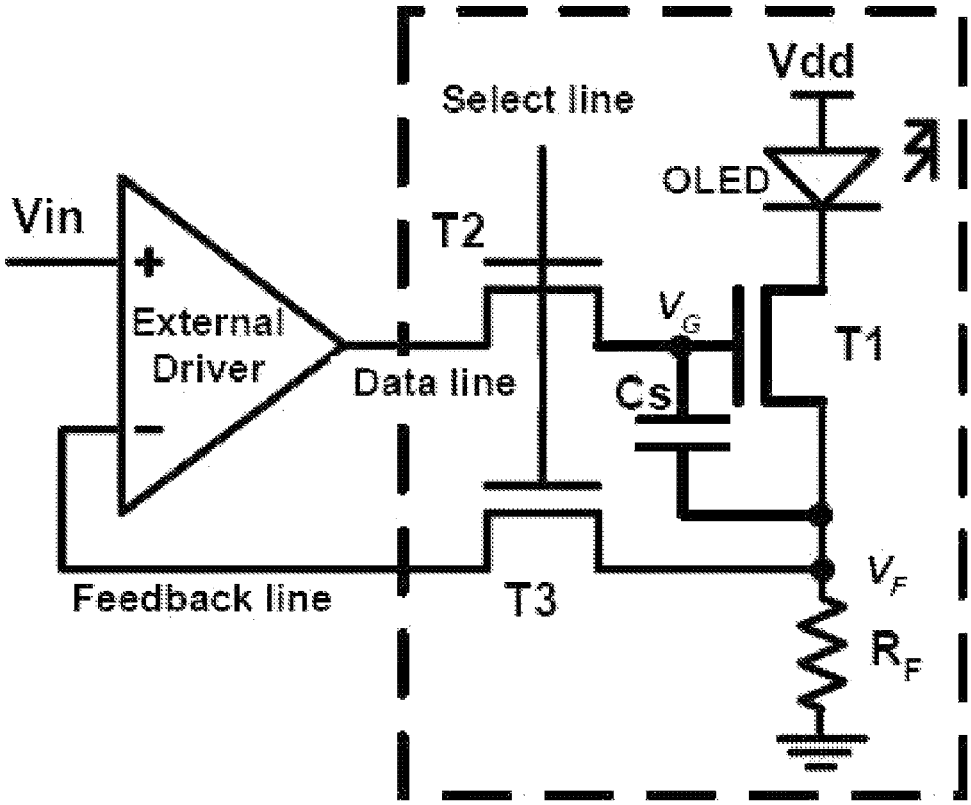

PRIOR ART
[Figure 5]
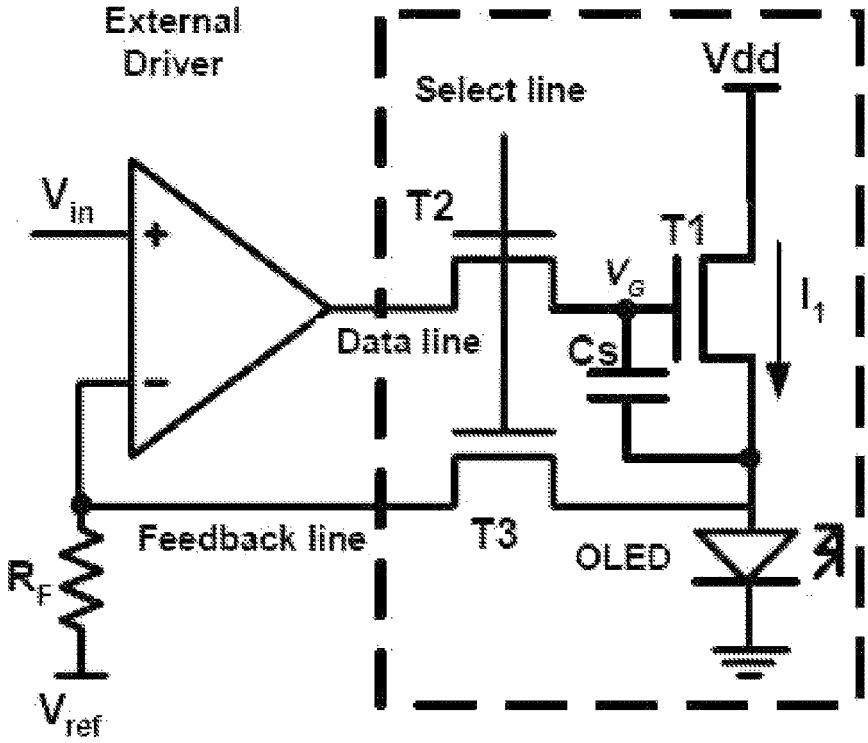

PRIOR ART
[Figure 6]
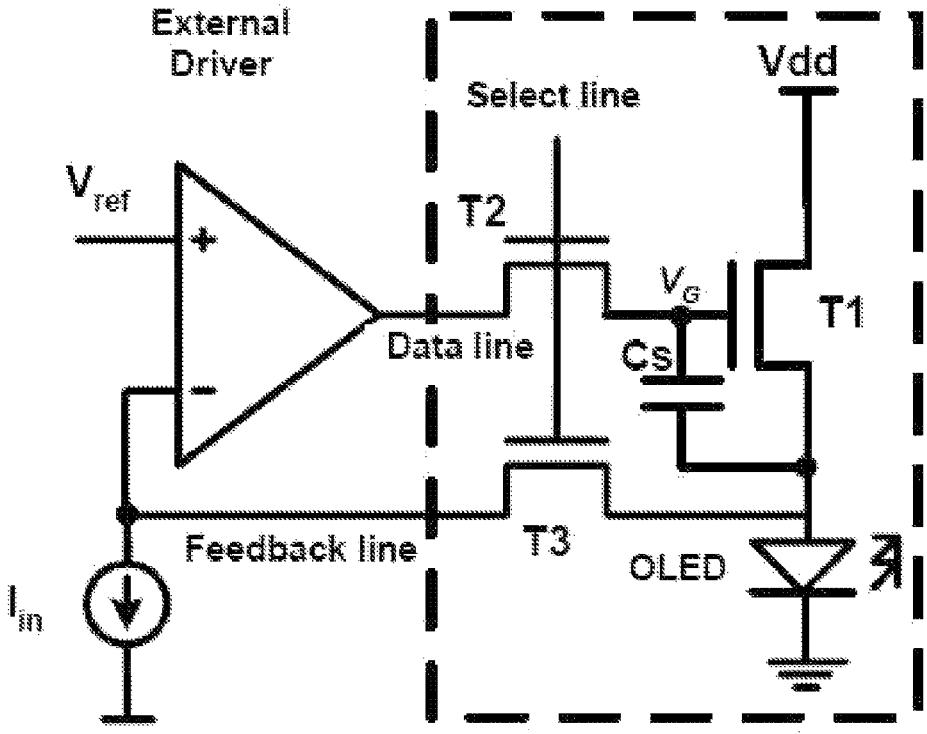

[Figure 7]
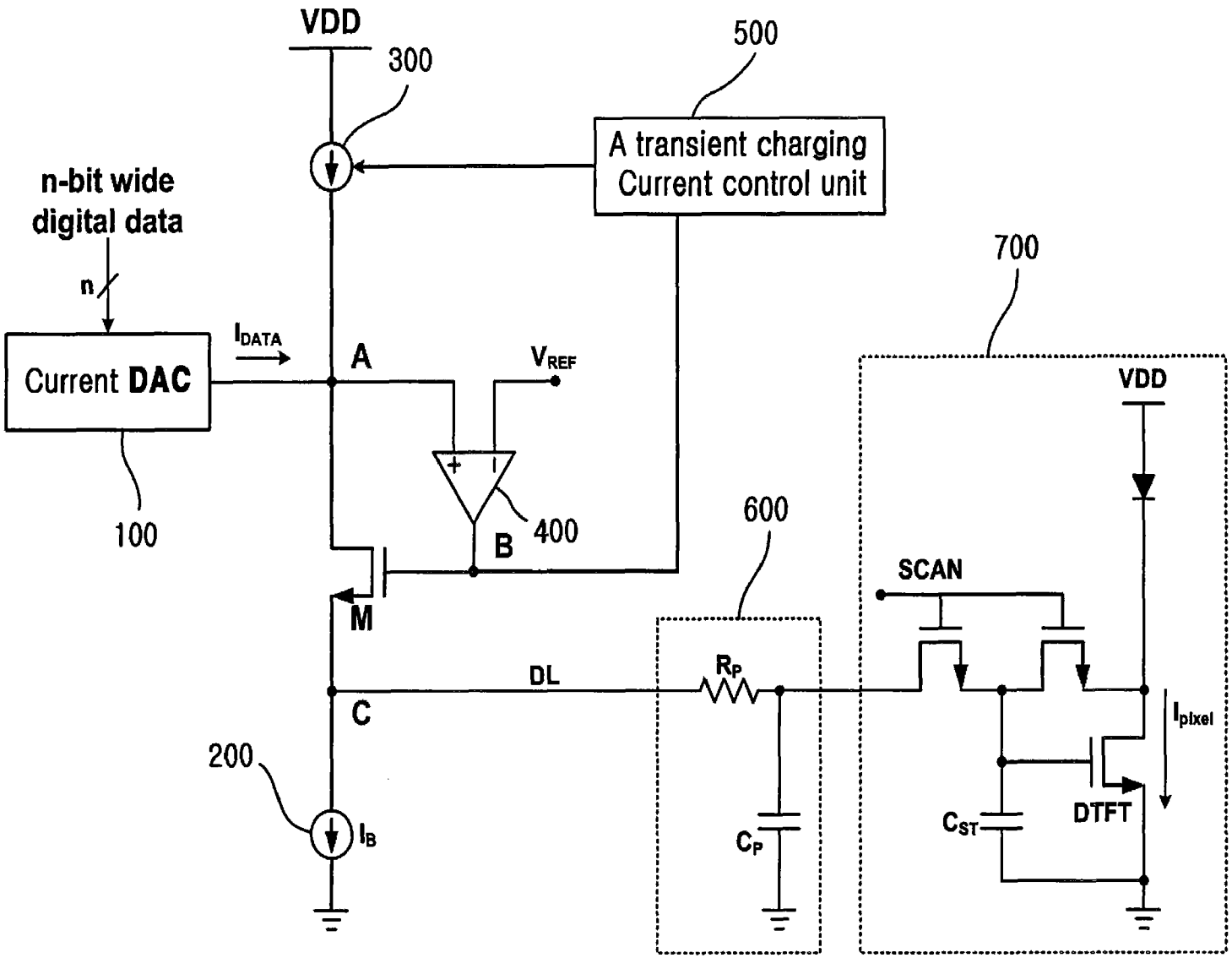

[Figure 8]
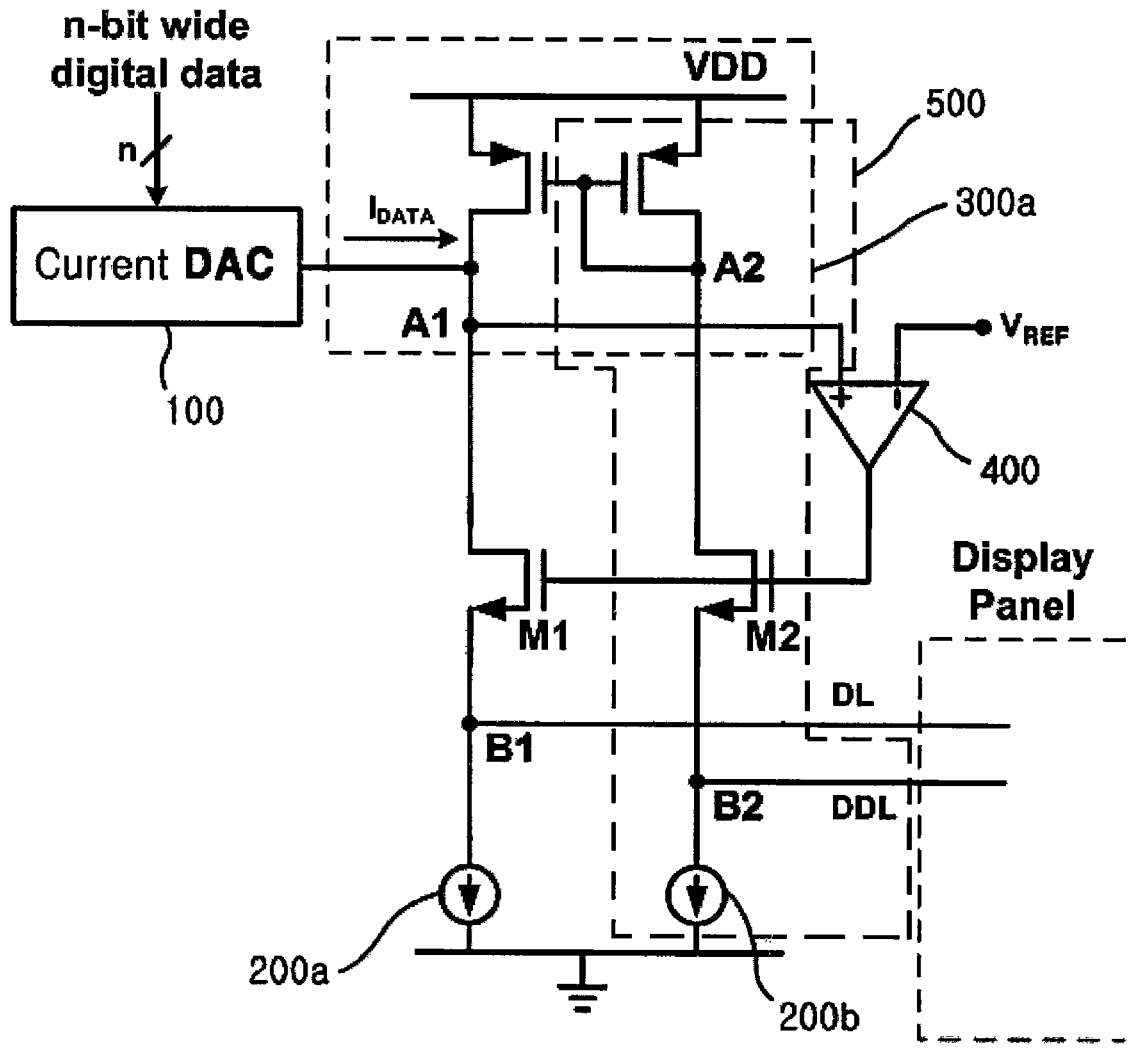

[Figure 9]
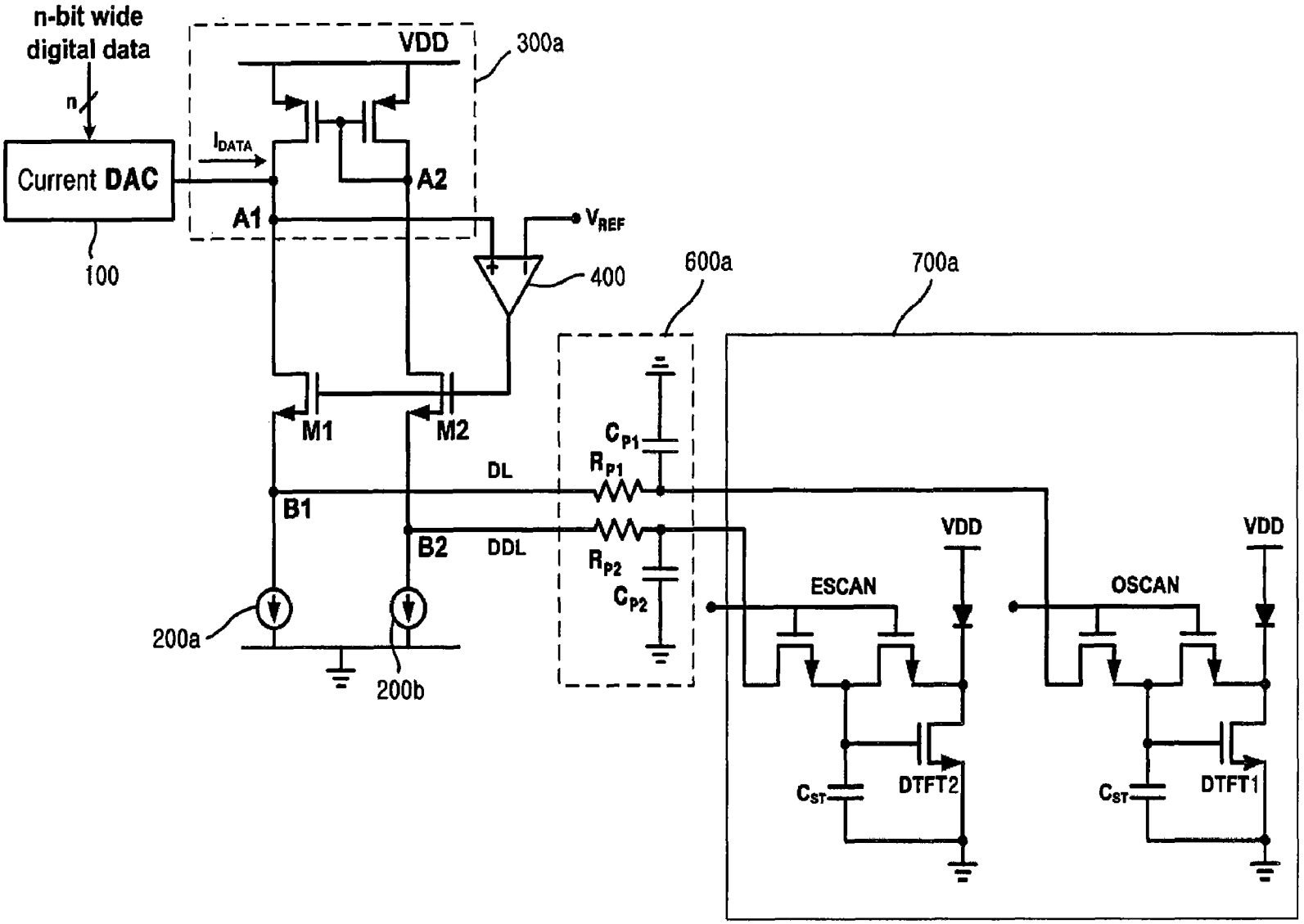

[Figure 10]
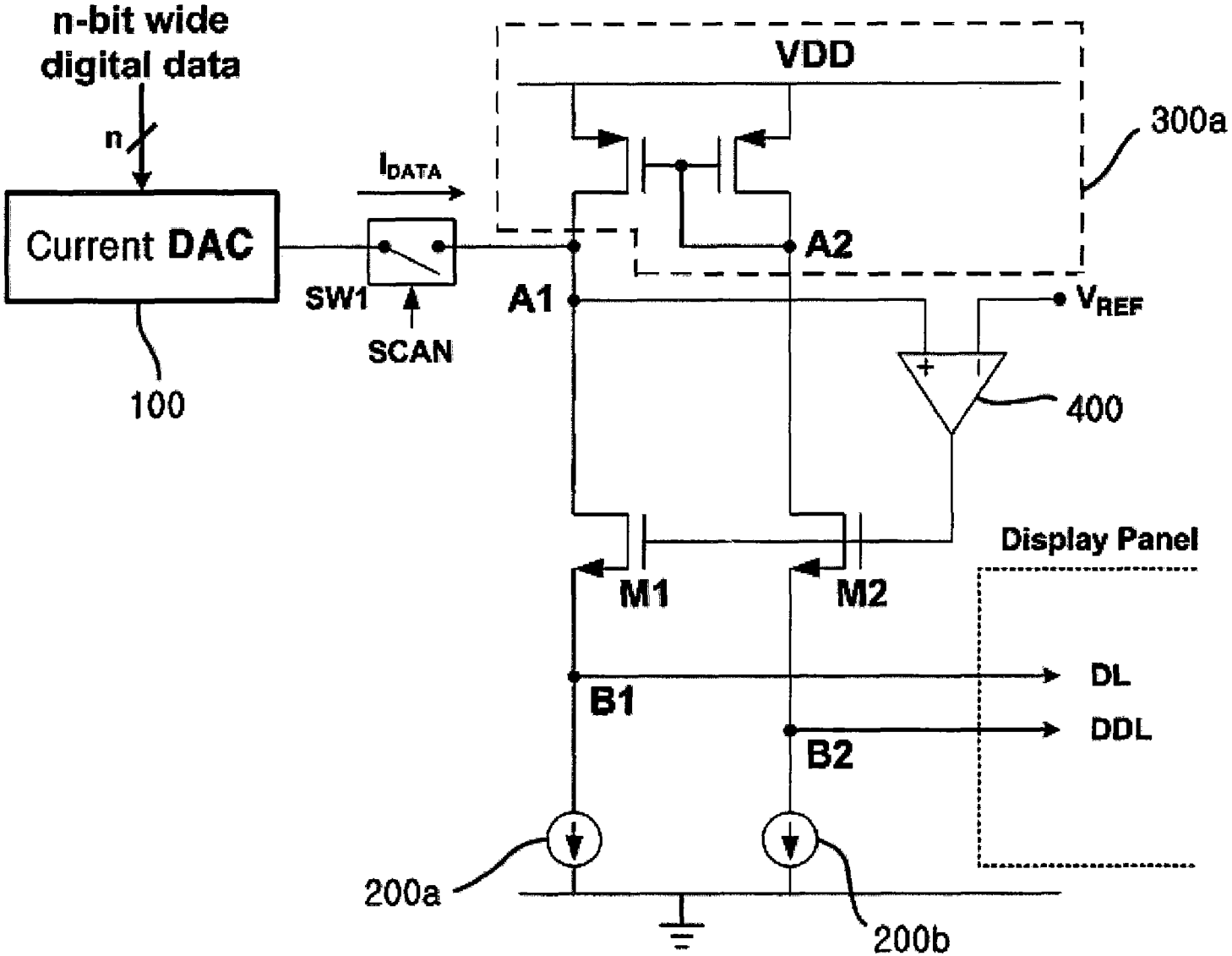

[Figure 11]
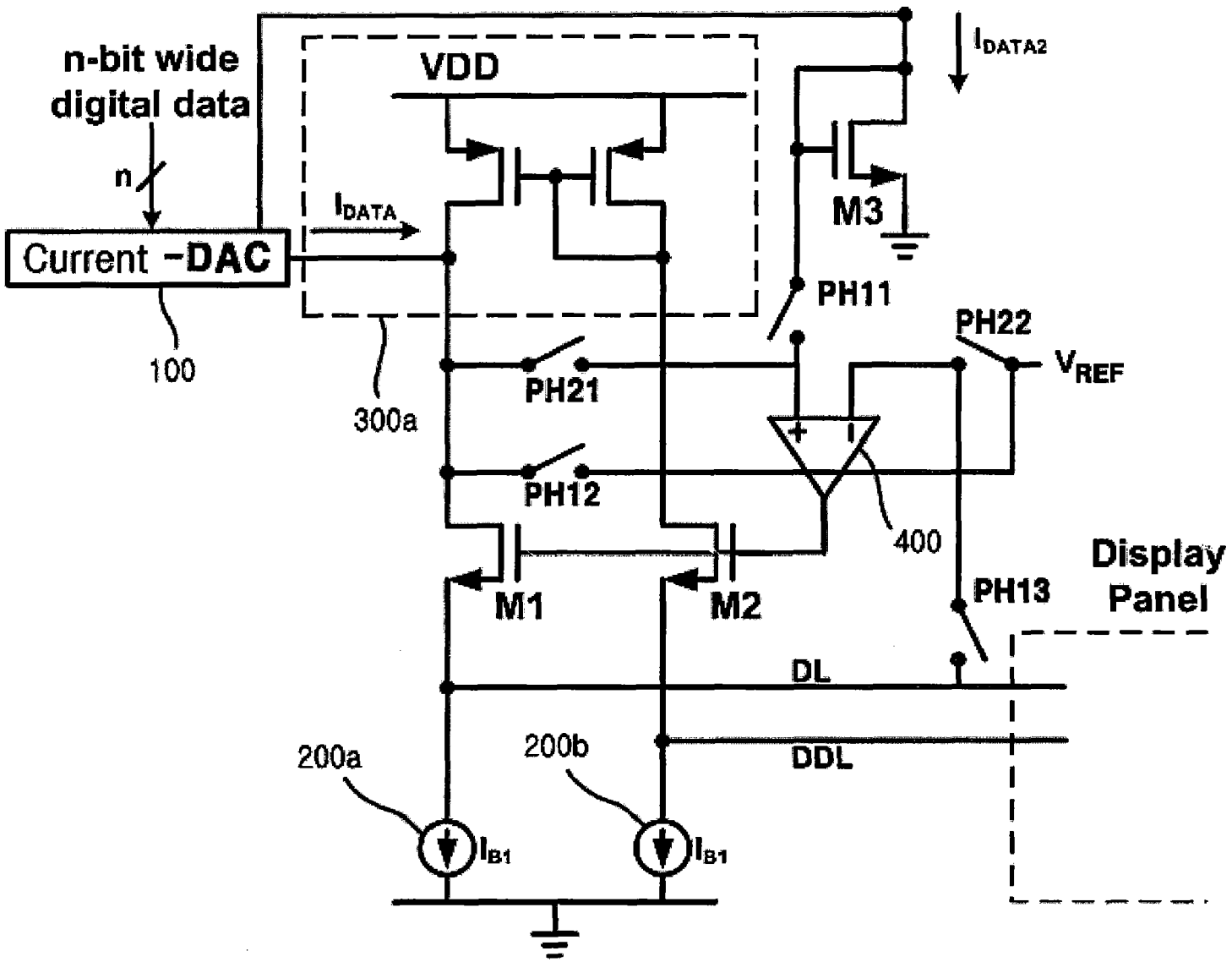

[Figure 12]
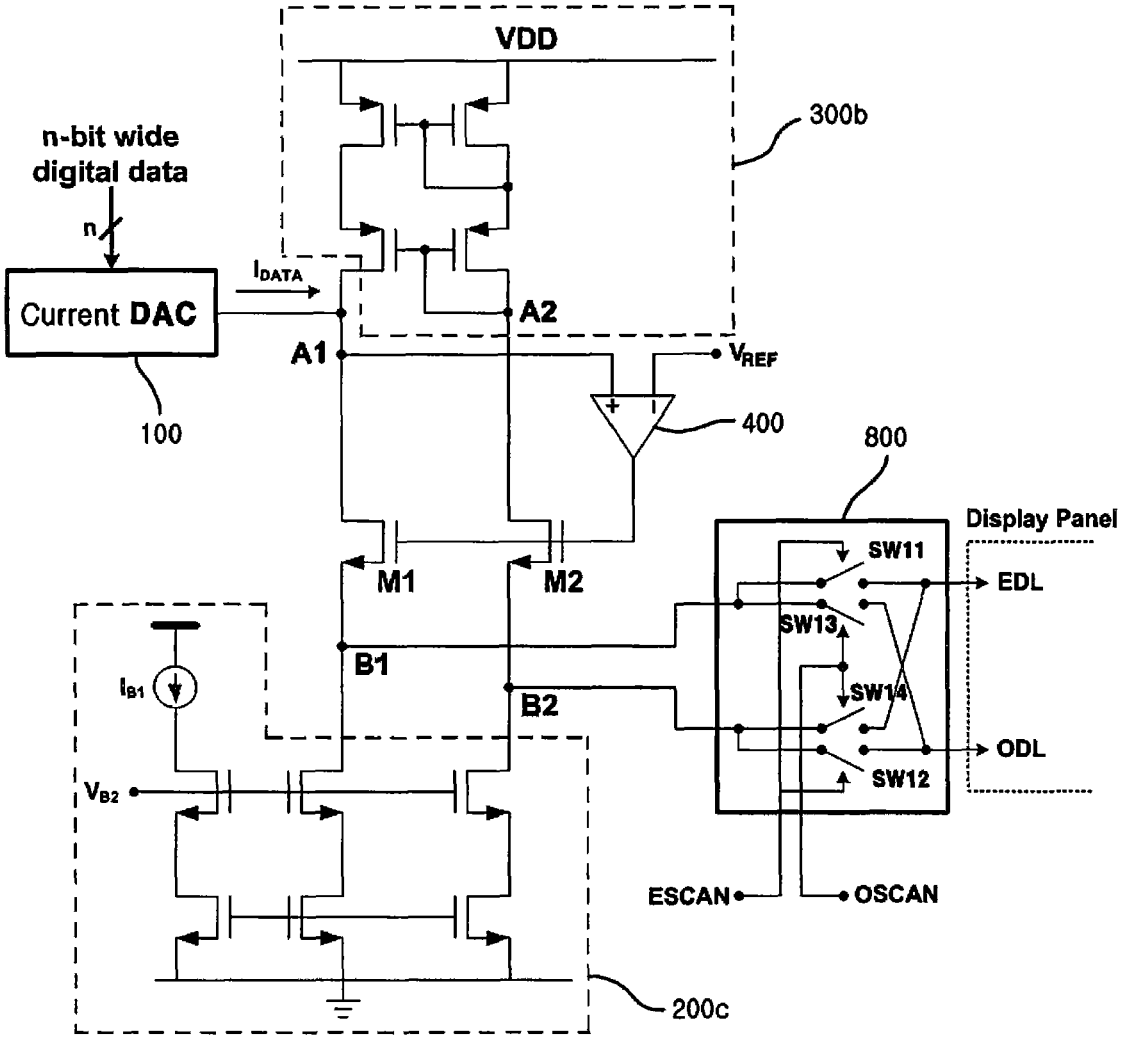

[Figure 13]
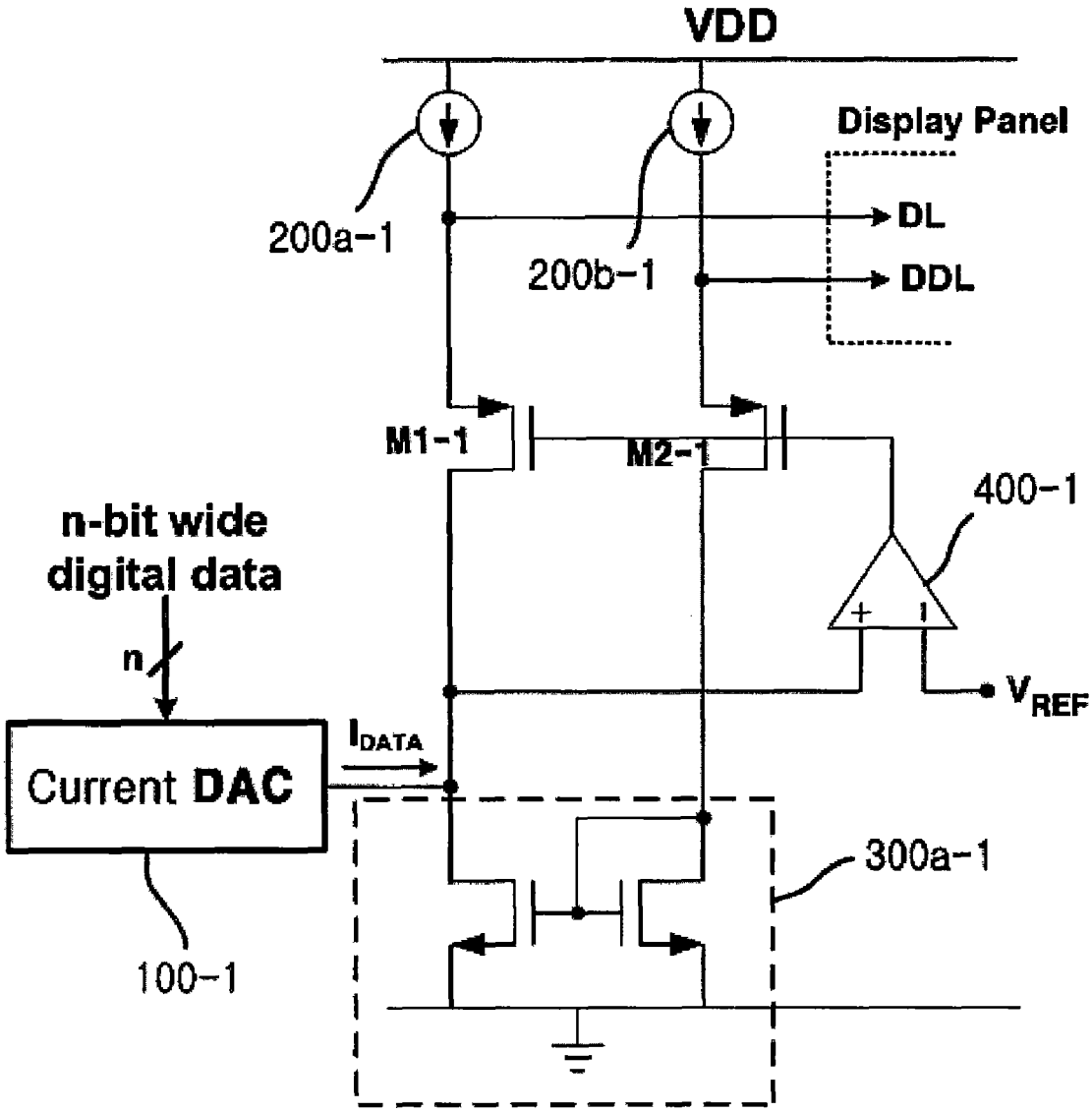

[Figure 14]
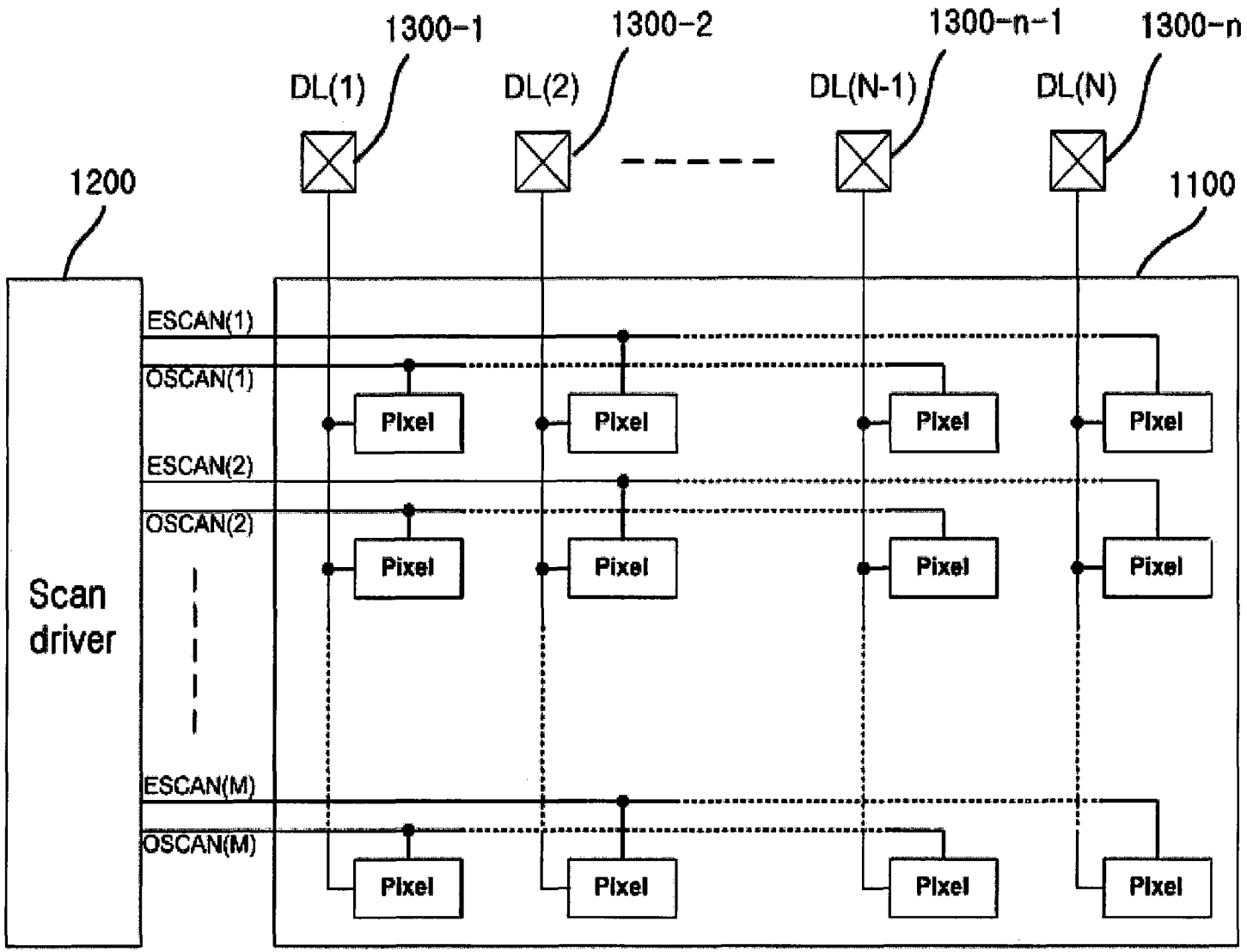

[Figure 15]
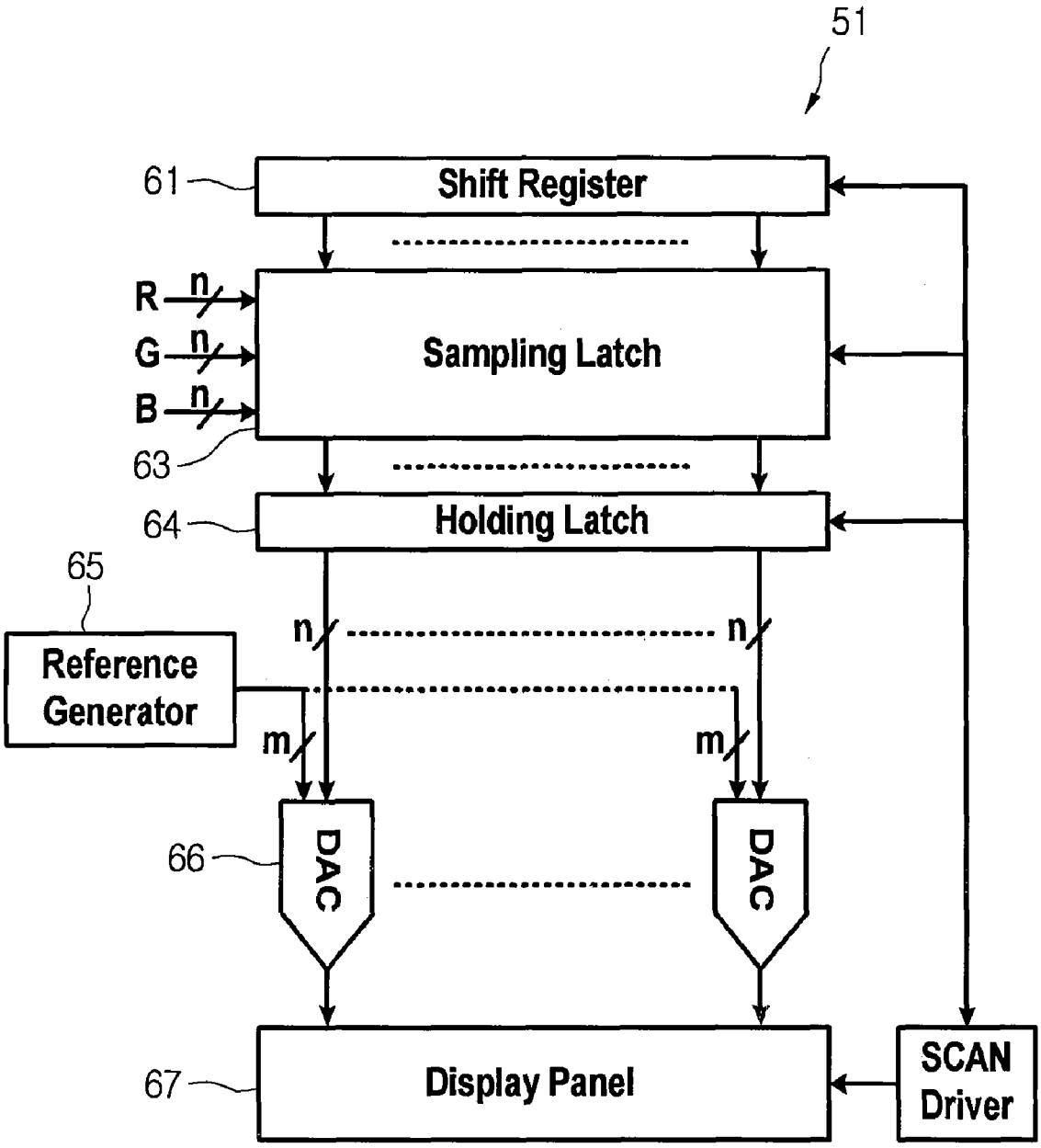

[Figure 16]
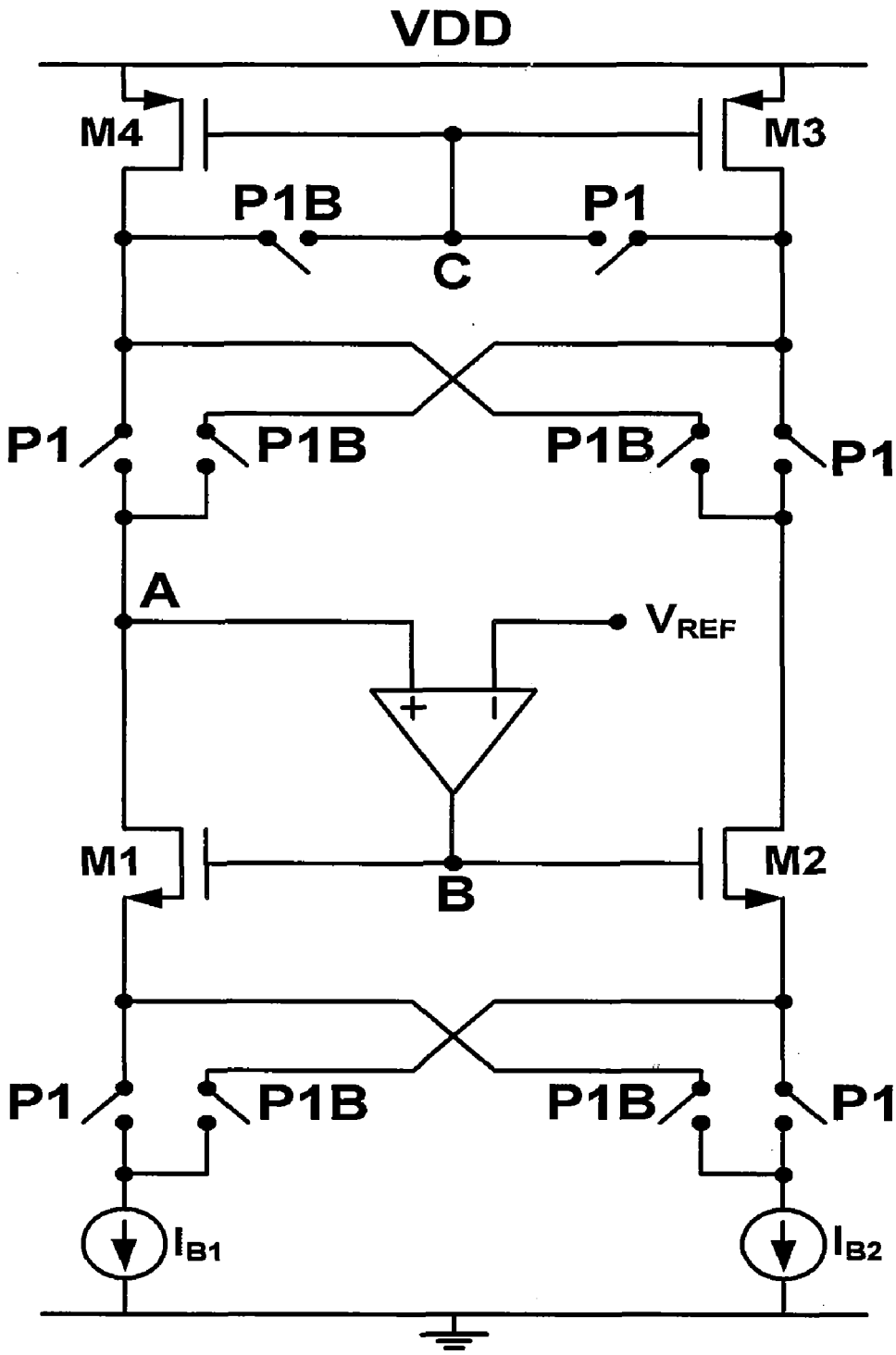

[Figure 17a]
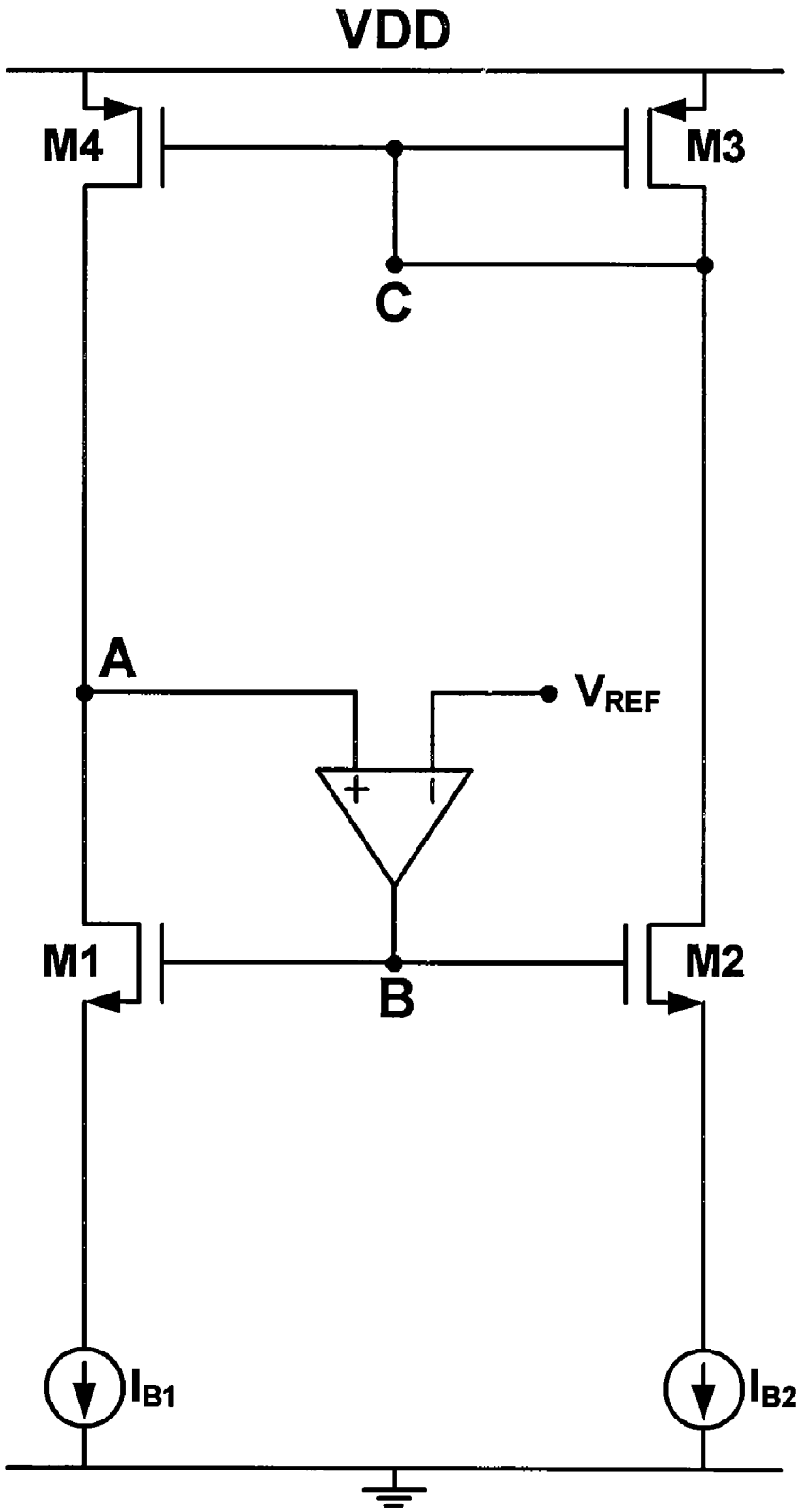

[Figure 17b]
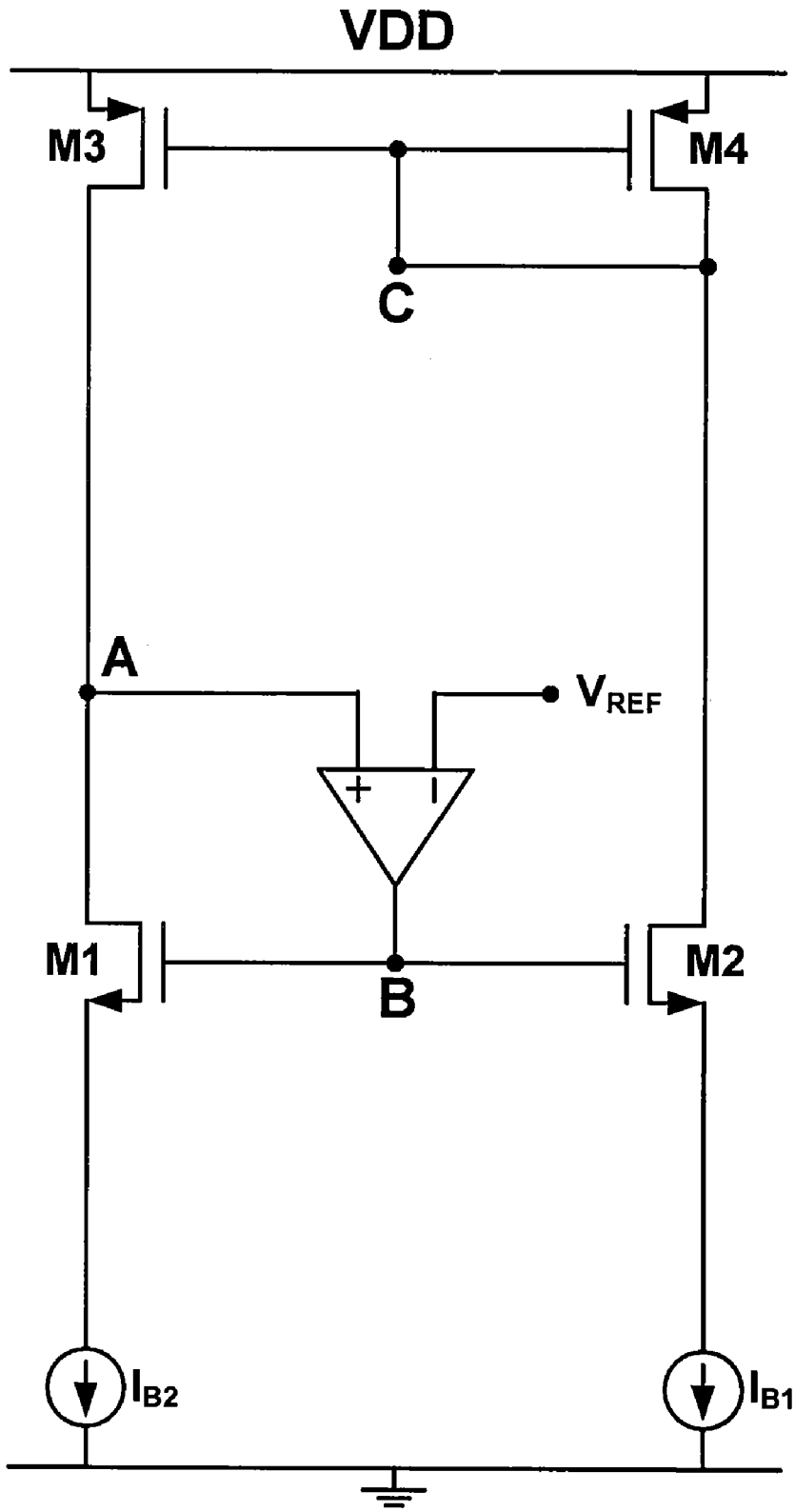

AMOLED DRIVE CIRCUIT USING TRANSIENT CURRENT FEEDBACK AND ACTIVE MATRIX DRIVING METHOD USING THE SAME

BACKGROUND OF THE INVENTION

1. Field of the Invention

The present invention relates generally to a drive circuit for a flat panel display device and a driving method using the drive circuit and, more particularly, to an Active Matrix Organic Light-Emitting Diode (AMOLED) drive circuit using transient current feedback and an active matrix driving method using the AMOLD drive circuit, which, when an AMOLED display device is driven in a current mode, can overcome a decrease in driving speed, which is caused by charging or discharging due to the parasitic capacitance of data lines, using current feedback based on the detection of transient charging current, and which divide the data lines of a display panel into even data lines and odd data lines and alternately perform a data write operation on the even data lines and the odd data lines, thus reducing the number of channels of a drive Integrated Circuit (IC).

2. Description of the Related Art

An Organic Electroluminescent (OEL) device, which is a new type of flat display device, is a self-emitting device, so that it has an excellent viewing angle and contrast ratio compared to a Liquid Crystal display (LCD) device. Furthermore, the OEL device does not require a backlight, and thus it can be implemented to have a light weight and a thin size and also has an advantage in power consumption.

Furthermore, the OEL device has many advantages in that it can operate at a low Direct Current (DC) voltage, has a fast response speed, is robust to external impact because it is formed of solid-state components throughout, and can be used in a wide temperature range. In particular, the OEL device has an advantage in that the manufacturing cost is low. Such an OEL device is called an Organic Light Emitting Diode (OLED).

Unlike an LCD device or a Plasma Display Panel (PDP) device, the OEL device is manufactured through a very simple process, and thus the process can be sufficiently performed using only deposition and encapsulation equipment.

Particularly, in an active matrix scheme, a storage capacitor ($C_{ST}$) is charged to a voltage for controlling current, which is applied to pixels, so that the charged voltage can be applied until a subsequent frame signal is applied, therefore the pixels can be continuously driven during one frame period regardless of the number of gate lines.

Accordingly, the active matrix scheme can achieve the same brightness even when a low current is applied, therefore it has advantages in that it can be manufactured to have low power consumption, high definition, and a large size.

Conventional display devices, each of which uses the flat panel display element having the above-described characteristics, are described with reference to U.S. Pat. Nos. 6,433,488 and 6,809,706 below.

FIG. 1 is a representative circuit diagram disclosed in U.S. Pat. No. 6,433,488. A drive transistor 21 and an OLED 1, which is a light-emitting element, are connected in series to each other, so that the same current flows through the drive transistor 21 and the OLED 1 in a data writing period. This current is called drive current, and is transferred to one input terminal of a current comparator 6 through a switching transistor 53.

The current comparator 6 has two input terminals and one output terminal, compares drive current with reference current, and outputs a voltage, corresponding to the result of the comparison, to a data input terminal to make the value of the drive current the same as the reference current. This output voltage is input to the gate of the drive transistor 21 through a switching transistor 22.

FIG. 2 is a circuit diagram showing the circuit of FIG. 1 in detail. The core circuits of the drive circuit are circuits for implementing a current comparison circuit and converting the output of the current comparison circuit into voltage. That is, the current comparator 6 includes a current mirror REF for generating reference current, another current mirror DRV for generating drive current, and the current comparison circuit for comparing the outputs of the current mirrors REF and DRV and outputting a voltage.

As described above, the output of the current comparator 6 is input to the gate of the drive transistor 21 through the switching transistor 22.

The operation of FIGS. 1 and 2 has been described based on the signal paths formed during the data writing period.

FIG. 3 is a representative circuit diagram disclosed in U.S. Pat. No. 6,809,706. A drive transistor Tr2 and a light-emitting element 1 are connected in series to each other. A differential amplifier 25 is automatically controlled by the voltage of the anode of the light-emitting element 1, that is, a node J, so that the time-varying characteristic of a drive transistor Tr2 and spatial characteristic distribution in a panel can be overcome, therefore uniformity in brightness of a screen can be achieved.

The voltage of the node J follows the voltage of the reference input terminal 11 the differential amplifier 25 by the operation of the differential amplifier 25 and a feedback operation. Accordingly, drive current, which corresponds to the voltage of the reference input terminal 11 of the differential amplifier 25, flows through the drive transistor Tr2 and the light-emitting element 1.

In this case, under the assumption that the above-described operation is performed in the data writing period, the signal of a scan line 14 enters an enabled state, and thus all signal paths are connected to each other. In this state, as the differential amplifier 25 operates, the gate voltage of the drive transistor Tr2 is automatically controlled such that current, which is generated by the voltage applied to the anode of the light-emitting element 1, that is, the node J, flows through the drive transistor Tr2.

FIG. 4 is a circuit diagram showing a drive circuit using voltage feedback, which is disclosed in a paper entitled "New Driving Method for a-Si AMOLED Displays Based on Voltage Feedback," published in the Society for Information Display (SID) 2005.

The drive circuit substantially employs the considerable part of the principle disclosed in U.S. Pat. No. 6,809,706. An input voltage $V_{in}$ is continuously compared with feedback voltage $V_F$ through a feedback operation. When a voltage applied to a resistor $R_F$ is equal to the input voltage $V_{in}$, current through the resistor $R_F$ is determined by $V_{in}/R_F$.

The gate voltage of a drive transistor T1 is automatically set by a differential amplifier (external driver) such that the current flows through the drive transistor T1 connected in series with the resistor $R_F$. That is, the drive circuit allows current, which flows through an OLED, to be determined by $V_{in}/R_F$, so that it can transfer data current, independent of the drive transistor T1, to the drive transistor T1 of a pixel circuit.

In this case, under the assumption that the above-described operation is also performed in the data writing period, the signal of a select line enters an enabled state, and thus all signal paths are connected to each other. The drive circuit has been described with the assumption that the distribution and time-varying characteristic of resistor $R_F$ are better than those of the drive transistor T1. This assumption is true in reality.

The drive circuit of FIG. 5 is a circuit that is implemented so as to be applied as a simpler pixel circuit when applying the drive circuit of FIG. 4 to a display panel. When implemented as described above, the drive circuit has a structure in which one resistor $R_F$ is connected to one data line, so that the characteristics of that data line can be uniformly controlled.

The drive circuit of FIG. 6 is a circuit that is implemented so as to perform a low current data write operation, in which the drive circuit of FIG. 5 causes a problem.

In the drive circuits of FIGS. 4 and 5, the input voltage $V_{in}$ must have a very small value, or the resistor $R_F$ must have a very large value in order to generate extremely low current. This causes a problem that cannot be overcome in practice. Accordingly, another drive circuit is required to realize data writing using extremely low current. FIG. 6 shows a circuit structure that has been proposed as an alternative for achieving this purpose.

In the drive circuit (U.S. Pat. No. 6,433,488) of FIGS. 1 and 2, described above, parasitic capacitance is generated by a data line drive current input terminal and the current comparator, thus there is a problem in that it is difficult to ensure feedback loop stability due to the capacitance.

In particular, the drive circuit of FIG. 2 is a circuit which is impossible to operate. The reason for this is because the drain of the transistor N3 of the current comparator is connected to a voltage source Vpp, and thus the feedback loop of the drive circuit is incomplete.

Furthermore, in the drive circuit, the accuracy of the data drive current is largely limited. The reason for this is because the current mirrors are simple mirrors. Another problem, in addition to the above-described problems, occurs in that two lines, which are electrically connected to a drive chip, are required to drive a single data line on a display panel (one line forms a drive current path, and the other forms a data line path).

Furthermore, from the point of view of the drive chip, the degree of integration is generally determined by the distance between data channels. If the drive chip requires two electrical paths to drive a single data line, the degree of integration thereof necessarily becomes lower than that of a typical drive chip.

Furthermore, in order to normally implement the drive circuit of FIG. 3, there must not be any characteristic difference between the pixels of OLED elements, which are light-emitting elements, and there must not be any time-varying characteristic. However, the OLED elements that form respective pixels generally exhibit differences in characteristics therebetween. In particular, the OLED elements generally exhibit excessive variation in characteristics as the duration of use thereof increases. The variation in the characteristics depending on the duration of use thereof may cause a situation in which it is difficult to smoothly operate the drive circuit of FIG. 3.

The drive circuit of FIG. 4 can guarantee the uniformity of display only when resistors are formed in respective pixel circuits and have considerable matching characteristics therebetween.

However, the resistors are generally implemented by controlling the doping density and geometrical shape of polycrystalline silicon. In the resistors that are made through two processes and using the feature of the material thereof, considerable matching characteristics cannot be acquired, and the matching characteristics cannot be ensured as the resistance values thereof increase. Particularly, in the case where resistors must be implemented to correspond to respective pixel circuits, as in FIG. 4, the distribution thereof may be not smaller than that of drive Thin Film Transistors (TFTs).

The drive circuit of FIG. 5 has a structure in which the number of transistors, which is the cause of the problems in the drive circuit of FIG. 4, is greatly reduced. Furthermore the drive circuit has a structure in which one resistor is disposed to correspond to each data line, and pixel circuits, which share the same data line, uses the resistor. However, although, in the drive circuit of FIG. 5, the number of pixel circuits is greatly reduced in contrast to the case of FIG. 4, it cannot be expected that conditions necessary to match the resistors of respective data lines will be decreased or greatly improved.

As the common feature of the conventional drive circuits, shown in FIGS. 1 to 6, one data line and one sensing line are required to drive one data line, and an economical circuit structure and driving method are not used from the point of view of the drive chip.

SUMMARY OF THE INVENTION

Accordingly, the present invention has been made keeping in mind the above problems occurring in the prior art, and an object of the present invention is to provide an AMOLED drive circuit using transient current feedback, which detects transient charging current and causes the detected current to be fed back as the charging current of data lines, thus realizing a fast data driving speed in a low current region.

Another object of the present invention is to provide an active matrix driving method using the AMOLED drive circuit, which divides the data lines of a display panel into two groups, that is, an odd data line group and an even data line group, and alternately performs a data write operation, thus reducing the number of drive channels required by a drive chip.

In order to accomplish the first object, the present invention provides a driver circuit for driving a display panel, comprising: a current Digital-to-Analog Converter (DAC) for generating driving current corresponding to input digital data; a plurality of data lines providing said driving current to an array of pixel prepared on the display panel by driving signal; an electric capacity unit existing on said each data line above and forming capacitive loading and a current mirror that mirrors current by connecting said each data line, wherein transient current charging of the data line activated by said driving signal uses transient current that is mirrored by said current mirror unit, and said transient current is induced to the electric capacity unit that exists on an dummy data line being adjacent to said activated data line.

A driver circuit for driving a display panel in the present invention further comprising a constant current source connected in the data line to charge and discharge the electric capacity; a data line drive transistor connected to an output node of the current DAC to switch the data line; compensatory switches which exchange paths of adjacent data lines to remove a mismatching effects, said paths on which the current constant current source and the data line drive transistor are located.

A driver circuit for driving a display panel in the present invention further comprising a switch which is locating between the current DAC and the current mirror unit, and said switch is switched by a logical sum of each scan signal of said data line and the dummy data line.

Said data lines are composed of an even data line group and an odd data line group; and a driver circuit for driving a display panel in the present invention further comprising a path switching unit that connects the even data line and the odd data line in order by scan signal of each group for providing the driving current to the even data line and the odd data line in turn.

In order to accomplish the first object, the present invention provides an AMOLED drive circuit using transient current feedback, including a current Digital-to-Analog Converter (DAC) for generating current corresponding to input digital data; a data line drive transistor configured such that the drain terminal thereof is connected to the output node of the current DAC; a constant current source connected between the source terminal of the data line drive transistor and a ground; a variable current source connected between both the output node of the current DAC and the drain terminal of the drive transistor, and a voltage source; a differential amplifier configured to input the output voltage thereof to the gate terminal of the drive transistor using the voltage of the output node of the current DAC as the input voltage of a non-inverting input terminal thereof, and using a predetermined constant voltage as the input voltage of the inverting input terminal thereof; and a transient charging current control unit connected between both the output node of the differential amplifier and the gate terminal of the drive transistor, and the variable current source, and configured to increase or decrease the bias current of the variable current source depending on variation in the voltage of the output node of the current DAC.

The transient charging current control unit includes a dummy data line, that is, a data line adjacent to a data line to which pixels, for which data writing is necessary, are connected on the matrix array of a display panel; a constant current source for functioning as a discharge current source when the dummy data line is discharged; a transistor configured such that the terminal thereof is connected to the voltage source, thereby forming a current mirror along with the variable current source; and a dummy data line drive transistor configured such that the drain terminal thereof is connected to the transistor and the gate terminal thereof is connected to the differential amplifier.

The AMOLED drive circuit further includes a switch which is configured such that one end thereof is connected to the current DAC, and the remaining end thereof is connected between the current mirror, which is formed of the variable current source and the transistor, and the data line drive transistor, and which is switched in response to a scan signal. The scan signal is a signal generated by an OR operation of a first scan signal, which is a scan signal for a pixel circuit connected to the data line, and a second scan signal, which is a scan signal for a pixel circuit connected to the dummy data line.

Furthermore, the AMOLED drive circuit further includes a path switching unit located between both the output terminals of the data line drive transistor and the dummy data line drive transistor and the display panel, and configured to form current paths for the data line and the dummy data line. The path switching unit includes a plurality of switches for forming a current path for an even data line, a current path for a dummy data line for the even data line, a current path for an odd data line, and a current path for a dummy data line for the odd data line.

Furthermore, the AMOLED drive circuit further comprises a precharge voltage generation transistor for generating data line precharge voltage using dummy data current supplied from the current DAC; a first precharge switch located between the gate terminal of the precharge voltage generation transistor and the non-inverting input terminal of the differential amplifier, and configured to be turned on during a precharge period of the data line; a second precharge switch configured such that one end thereof is connected to the inverting input terminal of the differential amplifier and the remaining end thereof is connected to the drain terminal of the data line drive transistor, and configured to turned on during the precharge period of the data line; a third precharge switch located between the data line and the inverting input terminal of the differential amplifier, and configured to be turned on during the precharge period of the data line; a first normal driving period switch configured such that one end thereof is connected to the non-inverting input terminal of the differential amplifier and the remaining end thereof is connected to the drain terminal of the data line drive transistor, and configured to be turned on during a normal data driving period of the data line; and a second normal driving period switch configured such that one end thereof is connected to the inverting input terminal of the differential amplifier and the remaining end is connected to the inverting input terminal of the differential amplifier, and configured to be turned on during the normal data driving period of the data line; wherein an amount of variation in transient voltage of the data line decreases due to generation of precharge voltage, thereby increasing a data driving speed.

In addition, the present invention provides an AMOLED drive circuit using transient current feedback, including a current DAC for generating current corresponding to input digital data; a dummy data line, that is, a data line adjacent to a data line to which pixels, for which data writing is necessary, are connected on the matrix array of a display panel; a current mirror for feeding back transient charging current, which is generated by a parasitic capacitance of the dummy data line, as data line charging current; first and second constant current sources for functioning as discharge current sources when the data line and the dummy data line are discharged; first and second drive transistors connected to the current mirror, and configured to drive the data line and the dummy data line; and a differential amplifier configured to input the output thereof to the gate terminals of the first and second drive transistors using a voltage of the output node of the current DAC as a voltage of the non-inverting input terminal thereof, and using a predetermined constant voltage as a voltage of the inverting input terminal thereof.

In addition, the present invention provides An AMOLED drive circuit using transient current feedback, including a current DAC for generating current corresponding to input digital data; a dummy data line, that is, a data line adjacent to a data line to which pixels, for which data writing is necessary, are connected on the matrix array of a display panel; a current mirror for feeding back transient charging current, which is generated by a parasitic capacitance of the dummy data line, as data line charging current; constant current sources for functioning as discharge current sources when the data line and the dummy data line are discharged; first and second drive transistors connected to the current mirror, and configured to drive the data line and the dummy data line; a differential amplifier configured to input the output thereof to the gate terminals of the first and second drive transistors using a voltage of the output node of the current DAC as a voltage of the non-inverting input terminal thereof, and using a predetermined constant voltage as a voltage of the inverting input terminal thereof; and a path switching unit located between both the output terminals of the first and second drive transistors and the display panel, and configured to form current paths for the data line and the dummy data line.

The path switching unit includes a first switch located between the source terminal of the first drive transistor and the display panel, and configured to be switched in response to a first scan signal and thus form a current path for an even data line; a second switch located between the source terminal of the second drive transistor and the display panel, and configured to be switched in response to the first scan signal and thus form a current path for a dummy data line for an even data line; a third switch located between the source terminal of the first drive transistor and the display panel, and configured to be switched in response to a second scan signal and thus form a current path for the odd data line; and a fourth switch located between the source terminal of the second drive transistor and the display panel, and configured to be switched in response to the second scan signal and thus form a current path for a dummy data line for the odd data line.

In order to accomplish the second object, the present invention provides a method of forming an active matrix, including assigning order to all of columns constituting an array of pixels arranged in M rows and N columns; dividing the columns into an even column group and an odd column group according to order; dividing all of rows, which constitute the array, into a first dependent row group and a second dependent row group; and defining pixels, which share the even column group, as the first dependent row group, and defining pixels, which share the odd column group, as the second dependent row group.

In addition, the present invention provides a method of driving an active matrix, including forming a single display frame by sequentially driving all of the pixels that share the even column group, and all of the pixels that share the odd column group.

BRIEF DESCRIPTION OF THE DRAWINGS

The above and other objects, features and advantages of the present invention will be more clearly understood from the following detailed description taken in conjunction with the accompanying drawings, in which:

FIG. 1 is a circuit diagram showing an example of a conventional drive circuit for a display device;

FIG. 2 is a circuit diagram showing the circuit of FIG. 1 in detail;

FIG. 3 is a circuit diagram showing another example of a conventional drive circuit for a display device;

FIG. 4 is a circuit diagram showing a further example of a conventional drive circuit for a display device;

FIGS. 5 and 6 are circuit diagrams showing respective examples of application of the circuit of FIG. 4;

FIG. 7 is a circuit diagram showing an AMOLED drive circuit using transient current feedback according to the present invention;

FIG. 8 is a circuit diagram showing an embodiment of the circuit of FIG. 7;

FIG. 9 is a circuit diagram showing a circuit to which the circuit of FIG. 8 is applied;

FIG. 10 is a circuit diagram showing an example of application of the circuit of FIG. 8;

FIG. 11 is a circuit diagram showing another example of application of the circuit of FIG. 8;

FIG. 12 is a circuit diagram showing the embodiment of the present invention in detail;

FIG. 13 is a circuit diagram showing a drive circuit which is complementary to the circuit of FIG. 8; and FIG. 14 is a diagram showing an example of the application of the display panel of the present invention FIG. 15 is a circuit diagram showing an a universal drive circuit for flat panel displays;

FIG. 16 is a circuit diagram showing another embodiment of an AMOLED drive circuit using transient current feedback according to the present invention;

FIG. 17*a* is a circuit diagram of FIG. 16 when the switch P1 is enabled and the switch P1B is disabled (mode 1);

FIG. 17*b* is a circuit diagram of FIG. 16 when the switch P1 is disabled and the switch P1B is enabled (mode 2).

DESCRIPTION OF THE PREFERRED EMBODIMENTS

Preferred embodiments of the present invention are described in detail with reference to the accompanying drawings below. However, the embodiments described below are disclosed only for illustrative purposes, and the details of the present invention are not limited to the embodiment described below.

FIG. 7 is a circuit diagram showing an AMOLED drive circuit using transient current feedback according to the present invention.

As shown in FIG. 7, the circuit for driving an active matrix display includes a current DAC 100 for receiving n-bit digital data and generating current corresponding to the digital data, a drive transistor M configured such that the drain terminal thereof is connected to the output node A of the current DAC 100 and the source terminal thereof is connected to a data line DL, a constant current source 200 connected between the source terminal of the drive transistor M and a ground, a variable current source 300 configured such that one end thereof is connected both to the output node A of the current DAC 100 and to the drain terminal of the drive transistor M and the other end thereof is connected to a voltage source side, and configured to enable current to flow from a voltage source VDD to the output node A of the current DAC 100 and the drain side of the drive transistor M, a differential amplifier 400 configured to input the output thereof to the gate terminal of the drive transistor M using the voltage of the output node A of the current DAC 100 as the input voltage of a non-inverting (+) input terminal thereof, and using a predetermined constant voltage $V_{REF}$ as the input voltage of an inverting (−) input terminal, and, and a transient charging current control unit 500 connected between both the output node B of the differential amplifier 400 and the gate terminal of the drive transistor M, and the variable current source 300, and configured to increase or decrease the bias current of the variable current source 300 depending on variation in the voltage of the output node A of the current DAC 100.

The current DAC 100 is a unit that receives n-bit digital data and outputs n-bit resolution current corresponding to the data. The output current $I_{DATA}$ of the current DAC 100 is current that must be finally transferred to the pixel circuit 700 of a display panel via the data line DL.

The output current $I_{DATA}$ of the current DAC 100 has a range of several nA to several μA, and is controlled so as to vary gradually according to the input of the digital data by several nA or several tens of nA.

The constant current source 200 functions as a discharge current source when the data line DL is discharged, enables the operating point of the drive transistor M to be set, and causes current to flow to the ground.

The drive transistor M is an N-type MOS transistor, and the data line DL is a data line to which pixels, for which data writing is necessary, are connected. The output current $I_{DATA}$ of the current DAC 100 flows into the data line DL.

Furthermore, reference numeral 600 (an electric capacity unit) indicates a circuit unit having a parasitic resistance and a parasitic capacitance that exist on the data line DL, and the electric capacity 600 has own capacitive loading, and reference numeral 700 indicates a certain current mode pixel circuit. In this case, a circuit complementary to the current mode pixel circuit may be implemented.

In the present invention constructed as described above, when the data line DL is driven in the current mode, the fundamental principle for solving a driving speed reduction problem, which occurs due to charging or discharging of the parasitic capacitance $C_P$ of the data line DL, is based on a method in which, when data is input, the data current $I_{DATA}$, which is generated by the current DAC 100, is transferred unchanged as pixel current $I_{Dpixel}$, and the parasitic capacitance $C_P$ is charged with current that is adaptively generated to charge or discharge the parasitic capacitance $C_P$.

Furthermore, the adaptive generation of the current for charging or discharging the parasitic capacitance $C_P$ is achieved through the constant current source 200, the variable current source 300, the drive transistor M, the differential amplifier 400, and the transient charging current control unit 500.

That is, when the data current $I_{DATA}$ generated by the current DAC 100 is supplied to the node A, the voltage of the node A increases, and thus the voltage of the output node B of the differential amplifier 400 also increases.

When the voltage of the node B increases, the data current $I_{DATA}$, which is the output current of the current DAC 100, can be transferred to the pixel circuit 700 only in the case where the voltage of the data line DL increases.

However, when the variable current source 300 has the same bias current as the constant current source 200, the parasitic capacitance $C_P$ must be charged only with the data current $I_{DATA}$.

Accordingly, the data driving speed can be increased in the case where the current of the variable current source 300 increases or decreases according to variation in the voltage of the output node A of the current DAC 100 and a charging or discharging operation is performed by the current difference between the current of the parasitic capacitance $C_P$ and the current of the constant current source 200.

The current difference between the constant current source 200 and the variable current source 300 occurs only in a transient state. The reason for this is because variation in the voltage of the node A does not occur in a steady state.

That is, the variable current source 300 supplies the same bias current as the constant current source 200 in the steady state, but the magnitude of the bias current varies according to variation in the voltage of the node A through the differential amplifier 400 and the transient charging current control unit 500 in the transient state.

In other words, the fact that the voltage of the output node A of the current DAC 100 increases indicates that, since pixel current $I_{Dpixel}$ is smaller than the data current $I_{DATA}$, the voltage of the data line DL must, be increased to make the magnitude of the pixel current $I_{Dpixel}$ the same as that of the data current $I_{DATA}$.

In this case, the current of the variable current source 300 must be increased to increase the voltage of the data line DL, and the current of the variable current source 300 increases under the control of the transient charging current control unit 500.

FIG. 8 is a circuit diagram showing an embodiment of the present invention. The embodiment includes a current DAC 100 for receiving n-bit digital data and generating current corresponding to the input digital data, a dummy data line DDL, that is, a data line adjacent to a data line DL to which pixels, for which data writing is necessary, are connected on the matrix array of a display panel, constant current sources 200*a* and 200*b* for functioning as discharge current sources when the data line DL and the dummy data line DDL are discharged, a current mirror 300*a* for feeding back transient charging current, which is generated by the parasitic capacitance of the dummy data line DDL, as current for charging the data line DL, drive transistors M1 and M2 respectively connected with the data line DL and the dummy data line DDL between the current mirror 300*a* and the constant current sources 200*a* and 200*b*, a differential amplifier 400 configured to input the output thereof to each of the gates of the drive transistors M1 and M2 using the voltage of output node A1 of the current DAC 100 as the voltage of a non-inverting (+) input terminal, using a predetermined constant voltage $V_{REF}$ as the voltage of an inverting (−) input terminal.

The constant current source 200*a* corresponds to the constant current source 200 of FIG. 7, the left side transistor of the current mirror 300*a* corresponds to the variable current source 300 of FIG. 7, and the drive transistor M1 corresponds to the drive transistor M of FIG. 7.

Furthermore, the constant current source 200*b*, the dummy data line DDL, the drive transistor M2, and the right side transistor of the current mirror 300*a*, which is configured such that one end thereof is connected to a voltage source side, constitute the transient charging current control unit 500.

Furthermore, the constant current sources 200*a* and 200*b* function as the discharge current sources when the data line DL and the dummy data line DDL are discharged, and enable the operating points of the current mirror 300*a* and the drive transistors M1 and M2 to be set. Furthermore, the magnitude of bias current varies according to the magnitude of the output current $I_{DATA}$ of the current DAC 100, so that the current-mirroring accuracy of the current mirror 300*a* can be increased.

The differential amplifier 400 is implemented using a typical differential amplifier, and rapidly responds to variation in the output current $I_{DATA}$ of the current DAC 100 by performing a function of maintaining the voltage of the output node A1 of the current DAC 100 at the constant voltage $V_{REF}$ of the inverting (−) input terminal of the differential amplifier 400.

The dummy data line DDL is a data line adjacent to the data line DL disposed on a matrix array, in which pixel circuits are disposed in a matrix form, and only functions as a transient current path. That is, no current flows therethrough at a steady state.

FIG. 9 is a circuit diagram showing a connection between a drive circuit and a panel, in which a circuit unit 600*a*, having parasitic resistances and parasitic capacitances that exist on the data line DL and the dummy data line DDL, and a pixel circuit 700*a* of a display panel is added to the drive circuit of FIG. 8. The operation of the present invention is described in greater detail with reference to FIG. 9 below.

First, under the assumption that an operation is performed from the starting point of an arbitrary data writing period, a scan signal OSCAN for the pixel circuit 700*a* connected to the data line DL is enabled, a scan signal ESCAN for the pixel circuit 700*a* connected to the dummy data line DDL is disabled, and the output current $I_{DATA}$ of the current DAC 100 is input to the node A1 in synchronization with the scan signal OSCAN for the pixel circuit 700*a* connected to the data line DL.

In this state, a data line charging phenomenon, which occurs in a state in which the data line DL and the dummy data line DDL have almost the same initial voltage and the respective gates of the drive transistors M1 and M2 are charged to a sufficiently low voltage, is described below.

When the data writing period is started, portions of current that flows through the drive transistors M1 and M2, respectively flow out through the data line DL and the dummy data line DDL, and thus each of the constant current sources 200*a* and 200*b* is not sufficiently supplied with current, in the case where the data line DL is connected to the node B1 of the output side, that is, source terminal side, of the drive transistor M1, and the dummy data line DDL is connected to the node B2 of the source terminal side of the drive transistor M2 while the current DAC 100, the current mirror 300*a*, the constant current sources 200*a* and 200*b* and the differential amplifier 400 operate in a normal state.

Accordingly, the voltage of each of the nodes B1 and B2 instantaneously decreases, nearly to ground level.

In this case, when the voltage of the node B2 decreases, the voltage of a node A2 decreases, so that the voltage of the node A2 decreases, therefore the amount of transient charges equal to the amount of charges flowing through the dummy data line DDL is supplied to the data line DL due to the current mirror effect of the current mirror 300*a*.

When the data line DL and the dummy data line DDL are charged as described above, the voltages of the nodes B1 and B2 increases, so that transient current charging is terminated and the normal state is reached.

When the normal state is reached, the output current $I_{DATA}$ of the current DAC 100 passes through the drive transistor M1 and flows into the drive transistor DTFT1 of the pixel circuit 700*a* via the data line DL.

In the above-described transient state, the differential amplifier 400 controls the gate voltages of the drive transistors M1 and M2 so that the voltage of the node A1 is always maintained at the voltage $V_{REF}$ of the inverting (−) input terminal of the differential amplifier 400. The above-described operation enables fast transfer of the output current $I_{DATA}$ of the current DAC 100 to the data line DL.

If the drive transistor M1 does not pass the output current $I_{DATA}$ of the current DAC 100 therethrough when the current is input to the node A1, the voltage of the node A1 increases, so that the gate voltage of the drive transistor M1 increases, therefore the voltage of the node A1 is maintained at the voltage $V_{REF}$ of the inverting (−) input terminal of the differential amplifier 400 and, at the same time, the output current $I_{DATA}$ of the current DAC 100 is exactly the same as the current that flows through the data line DL.

A data line discharge phenomenon, which occurs in a state in which the data line DL and the dummy data line DDL have the same initial voltage and the gates of the drive transistors M1 and M2 are charged to a sufficiently high voltage, is described below.

The transient current discharge phenomenon allows data writing to be simply and more quickly completed compared to the transient current charge phenomenon.

When the data writing period is started, current that flows through the drive transistors M1 and M2 and current that flows out of the data line DL and the dummy data line DDL is input to the constant current sources 200 and 200, in the case where a data line DL is connected to the node B1 and a dummy data line DDL is connected to the node B2 while the current DAC 100, the constant current sources 200*a* and 200*b*, the current mirror 300*a* and the differential amplifier 400 operate in the normal state.

Accordingly, the voltages of the nodes B1 and B2 instantaneously increase, so that the differential amplifier 400 operates such that the gate voltages of the drive transistors M1 and M2 increase, therefore the voltage of the node A1 is rapidly settled to the voltage $V_{REF}$ of the inverting (−) input terminal of the differential amplifier 400.

The respective voltages of the nodes B1 and B2 are discharged through the constant current sources 200*a* and 200*b*. In this case, the amount of discharged charge is controlled by the differential amplifier 400 so that the precise output current $I_{DATA}$ of the current DAC 100 flows out through the data line DL.

FIG. 10 is a circuit diagram showing an example of the application of the circuit of FIG. 8. When compared to the embodiment of FIG. 8, the embodiment of FIG. 10 has a structure in which a switch SW1, which is configured such that one end thereof is connected to the current DAC 100 and the other end thereof is connected between the current mirror 300*a* and the drive transistor M1, is additionally provided.

The switch SW1 is switched by an OR signal generated by an OR operation between the scan signal OSCAN for the pixel circuit 700*a*, which is connected to the data line DL, and the scan signal ESCAN for the pixel circuit 700*a*, which is connected to the dummy data line DDL. When applied to an actual panel, the switch SW1 enables the transient time to be reduced.

In this case, the transient time refers to the time required until the current generated by the current DAC 100 is transferred as pixel current. The switch SW1 operates so as to minimize variation in the voltage of the node A1, thus enabling the transient time to be reduced.

FIG. 11 is a circuit diagram showing an embodiment for improving the driving performance thereof compared to the embodiment of FIG. 10. The embodiment of FIG. 11 enables the driving speed to increase using a precharge period and a normal data driving period.

The embodiment of FIG. 11 has a structure in which a transistor M3 for generating the precharge voltage of the data line DL using dummy data current $I_{DATA2}$ supplied from the current DAC 100, a first precharge switch PH11 located between the gate terminal of the transistor M3 and the non-inverting (+) input terminal of the differential amplifier 400 and configured to be turned on during the precharge period of the data line DL, a second precharge switch PH12 configured such that one end thereof is connected to the voltage ($V_{REF}$) terminal of the inverting (−) input terminal of the differential amplifier 400 and the other end thereof is connected to the drain terminal of the drive transistor M1 and configured to be turned on during the precharge period of the data line DL, a third precharge switch PH13 located between the data line DL and the inverting (−) input terminal of the differential amplifier 400 and configured to be turned on during the precharge period of the data line DL, a first normal driving period switch PH21 configured such that one end thereof is connected to the non-inverting (+) input terminal of the differential amplifier 400 and the other end thereof is connected to the drain terminal of the drive transistor M1 and configured to be turned on during the normal data driving period, and a second normal driving period switch PH22 configured such that one end thereof is connected to the inverting (−) input terminal of the differential amplifier 400 and the other end thereof is connected to the voltage ($V_{REF}$) terminal of the inverting (−) input terminal and configured to be turned on during the normal data driving period, are additionally provided to the elements of FIG. 8 instead of the switch SW1 FIG. 10.

In this case, the first to third precharge switches PH11 to PH13 and the first and second normal driving period switches PH21 and PH22 are configured to be switched on in response to an external control signal, which is not shown.

Furthermore, it is not necessary for the dummy data current $I_{DATA2}$ to be essentially the same as the actual data line drive current $I_{DATA}$, and the transistor M3 may be implemented in an arbitrary form so as to have current-voltage characteristics similar to those of the drive transistors constituting the pixel circuit 700*a* of the display panel.

The embodiment of FIG. 11, described above, allows the first to the third precharge switches PH11 to PH13 and the first and second normal driving period switch PH21 and PH22 to operate separately in the precharge period of the data line DL and the normal data driving period of the data line DL, thus increasing the driving speed.

The precharge period is a period for charging the data line DL with a certain voltage generated when the first to third precharge switches PH11 and PH13 are turned on and, thus, the dummy data current $I_{DATA2}$ flows through the transistor M3, and the normal data driving period is a period for turning on the first and second normal driving period switches PH21 and PH22, the operation of which is the same as in FIG. 10.

The embodiment of FIG. 11 can further increase the data driving speed by reducing the amount of variation in transient voltage of the data line DL through the addition of a precharge function to the operation of FIG. 10. The actual circuit thereof may be implemented by adding the path converter 800 of FIG. 12, which will be described later, to the embodiment. Furthermore, a circuit complementary to the embodiment may be implemented.

FIG. 12 is a circuit diagram showing the embodiment of FIG. 8 in detail.

Unlike the embodiment of FIG. 8, the embodiment of FIG. 12 includes a current mirror 300*b* and a constant current source 200*c*. The current mirror 300*b* is implemented using a stacked mirror to assure accuracy at the nanoampere (nA) level. The constant current source 200*c*, instead of the constant current sources 200*a* and 200*b*, is implemented in a cascade form. Furthermore, a path switching unit 800, which forms current paths for even and odd data lines EDL and ODL and current paths for dummy data lines for the even and odd data lines in response to scan signals ESCAN and OSCAN, is additionally provided between the source terminal of the drive transistors M1 and M2 and the display panel.

The path switching unit 800 includes a first switch SW11 located between the source terminal of the drive transistor M1 and the display panel and configured to be switched in response to the scan signal ESCAN and thus form a current path for the even data line EDL, a second switch SW12 located between the source terminal of the drive transistor M2 and the display panel and configured to be switched in response to the scan signal ESCAN and thus form a current path for a dummy data line for the even data line, a third switch SW13 located between the source terminal of the drive transistor M1 and the display panel and configured to be switched in response to the scan signal OSCAN and thus form a current path for the odd data line ODL, and a fourth switch SW14 located between the source terminal of the drive transistor M2 and the display panel and configured to be switched in response to the scan signal OSCAN and thus form a current path for a dummy data line for the odd data line.

In the above-described embodiment of the present invention, the switches SW11 and SW12 of the path switching unit 800 are switched in response to the scan signal ESCAN, thus forming the path for connecting with the even data line EDL via the switch SW11 and forming the path for the dummy data line for the even data line EDL via the switch SW12.

Furthermore, the switches SW13 and SW14 are switched in response to the scan signal OSCAN, thus forming the path for connecting with the odd data line ODL via the switch SW13 and forming the path for the dummy data line for the odd data line ODL via the switch SW14.

That is, the present embodiment uses two types of combinations for connection between nodes B1 and B2 and the even and odd data line EDL and ODL in response to the scan signals ESCAN and OSCAN.

Accordingly, from the point of view of the drive chip, the number of required data line driving channels can be halved.

In other words, the even data line EDL and the odd data line ODL are two data lines that are independent of each other on the display panel. Although, in a typical drive chip, two data line driving channels are required, the present invention requires only a single data line driving channel, allows two display panel data lines to be connected to the single data line driving channel, and allows the single data line driving channel to be shared by switching operations, thus halving the number of required data line driving channels.

Since, in the present embodiment, the operation of remaining parts, other than the path switching unit 800, is the same as in the above-described embodiment, detailed descriptions thereof are omitted.

FIG. 13 is a circuit diagram showing a drive circuit which is complementary to the circuit of FIG. 8.

As shown in FIG. 13, the complementary drive circuit of the present invention includes a current DAC 100-1 having an output current direction opposite that of the current DAC 100, a constant current source 200*a*-1 for supplying current in a direction from a voltage source (VDD) to the node of a data line DL and located between the voltage source VDD and the node of the data line DL, a constant current source 200*b*-1 for supplying current in a direction from the voltage source to the node of a dummy data line DDL and located between the voltage source VDD and the node of the dummy data line DDL node, a P-type data line drive transistor M1-1 configured such that the source terminal thereof is connected with the data line connection node of the constant current source 200*a*-1, the gate terminal is connected with the output terminal of a differential amplifier 400-1, and the drain terminal thereof is connected with the output terminal of the current DAC 100-1, a p-type dummy data line drive transistor M2-1 configured such that the source terminal thereof is connected with the dummy data line connection node of the constant current source 200*b*-1, the gate terminal thereof is connected with the output terminal of the differential amplifier 400-1, and the drain terminal thereof is connected to the output terminal of the current DAC 100-1, a P-type current mirror 300*a*-1 configured such that the current input terminal thereof is connected with the drain terminal of the drive transistor M2-1, and the current output terminal is connected to a node to which the output terminal of the current DAC 100-1 and the drain terminal of the drive transistor M1-1 are connected, and a differential amplifier 400-1 configured such that the non-inverting (+) input terminal thereof is connected to the output node of the current DAC 100-1, a predetermined constant voltage $V_{REF}$ is input to the inverting (−) input terminal thereof, and the output terminal thereof is connected with the gate terminal of the drive transistors M1-1 and M2-1.

Since the above-described complementary drive circuit of the present invention operates in the same manner as the circuit of FIG. 8, a detailed description thereof is omitted.

As shown in FIG. 15, FIG. 15 shows a universal driver circuit 51 for flat panel displays such as TFT-LCDs, PMOLED displays, AMOLED displays and PDP displays. Operation of the universal driver circuit 51 will be described, for example.

The shift register circuit 61 uses inputted clock signal SCK to shift (propagate) a start pulse input signal inputted from the controller circuit (not shown) and outputs it.

The sampling Latch circuit 63 samples the display data signals (for example, R, G and B signals of 6 bits each and 18 bits in total) sent in a time-division manner, from output signals of stages of the shift register circuit 61. And the sampling Latch circuit 63 stores the display data signals until a latch signal is input from the controller circuit (not shown) to the hold Latch 64.

When the latch signal is input, to the hold Latch circuit 64, the display data stored in the sampling Latch circuit 63 is input to the hold Latch circuit 64. Thus, the display data signals for one horizontal period of the display data signals R, G and B are latched, that is, are held.

When the display data signals for the next one horizontal period are input from the sampling Latch circuit 63, the held display data signals are output to the D/A converter circuit (DAC) 66.

The D/A converter circuit (DAC) 66 converts the R, G and B display data signals (digital) of 6 bits each input from the hold Latch circuit 64 to analog signals accordingly and outputs to the display panel 67.

The display image quality mainly depends on driving performance of the column driver. For an example, for enhancing driving capability of DAC the voltage buffer amplifiers are used in TFT-LCD applications. The voltage buffer amplifiers can provide driving capability for capacitive loads in voltage-mode driving such as previously mentioned TFT-LCD applications.

In current-mode driving, in order to enhance driving capability another circuit should be added at the output of DACs instead of voltage buffer amplifiers. For example, TCFD has been comprised for enhancing current driving capability and speed of data transfer into a pixel in a display panel.

As shown in FIG. 16, FIG. 16 shows another embodiment of an AMOLED drive circuit using transient current feedback according to the present invention.

In realized circuits, mismatching between transistors M3 and M4 and mismatching between current sources $I_{B1}$ and $I_{B2}$. Generally, the mismatching is generated due to the non-ideal characteristics of IC fabrication process.

In order to compensate the effects of these two mismatching, the driver circuit can be designed with switches as shown in FIG. 16. The control states (or phase) of the switches divided into two, i.e., P1 and P1B. P1B has the phase difference of 180 degrees from P1.

In general, the image of display system is formed by averaging instantaneous multiple frames. For removing the mismatching effects, the driving circuit can be operated in mode 1 for odd frames and in mode 2 for even frames. The combination that mode 2 for odd frames and in mode 1 for even frames is possible. The mode 1 represents that P1 is enabled and P1B is disabled ant the mode 2 represents that P1B is enabled and P1 is disabled as shown in FIGS. 17*a* and 17*b*. The mode 1 is the default setting and the mode 2 has the effects of exchanging M3, M4 and $I_{B1}$, $I_{B2}$.

The combined operation of the mode 1 and mode 2 can make the averaging effects of offsets generated from mismatches between transistors M3 and M4, mismatches between current source $I_{B1}$ and $I_{B2}$ evidently.

The equations that explain this effect are omitted because of clearance.

FIG. 14 is a diagram showing an example of the application of the display panel of the present invention. Reference numeral 1100 indicates a display panel including pixels (active matrix array), reference numeral 1200 indicates a scan driver, and reference numerals 1300-1, . . . 1300-*n* indicate pads that are disposed at respective locations at which the data driver and the display panel 1100 are connected to each other. In this case, the scan driver 1200 may be implemented using a semiconductor chip, or may be implemented on the panel using TFT.

In the present invention, the active matrix structure of the display panel 1100 is configured such that pixels, which are physically disposed along the same row, are divided into two groups in order of data lines. Here, when the leftmost data line is defined as DL 1 and the rightmost data line is defined as DL N, the order of data lines refers to the order of even data lines and odd data lines.

The pixels, which are physically disposed along the same row, are divided to be disposed on two rows, that is, an even scan (ESCN) row and an odd scan (OSCN) row. The ESCN row is shared by pixels located at the even data lines, and the OSCAN row is shared by pixels located at the odd data lines.

The data write operation is performed by writing data through OSCAN row scanning, which is performed in order from OSCAN 1 to OSCAN M, and through ESCAN row scanning, which is performed in order from ESCAN 1 to ESCAN M. In this case, the ESCAN row scanning may be performed first, and the OSCAN row scanning may be performed later.

From the point of view of the data lines, the above-described data write operation is performed in such a way that data writing is sequentially performed on pixels that share an odd data line, according to their row numbers, and is then sequentially performed on pixels that share an even data line, according to their row numbers.

In this case, the data writing according to row numbers may be performed in descending or ascending order. Furthermore, from the point of view of the construction of a frame, an existing frame is divided into two frames in the order of data strings, and data writing is performed on each of the two frames.

For convenience of the data write operation, a single dummy row or respective dummy rows may be used for the uppermost dummy row and the lowermost dummy row.

In this case, the data driving can be more easily performed in such a way that pixel circuits having actual light-emitting elements are driven after data driving has been first performed on dummy rows, or each of the dummy data lines or each of the data lines is charged or discharged to a certain voltage before data driving for a subsequent row is started after data driving for an arbitrary row has been completed. In this case, the dummy data lines and the data lines may be charged or discharged to the same voltage.

As described above, the present invention has the following effects:

First, current for charging the respective parasitic capacitance of the data lines is adaptively generated, and thus a data driving speed reduction problem, which occurs due to charging or discharging of the respective parasitic capacitance of the data lines when the data lines are driven in the current mode, can be solved.

Second, transient charging current is detected from the parasitic capacitance of a neighboring data line and is fed back as current for charging a data line, thus a large-sized AMOLED display panel, the driving speed of which is limited due to parasitic capacitances in a low current driving region, can be effectively driven.

Third, data writing is alternately performed on data lines, that is, even data lines and odd data lines, so that the number of data line driving channels required by the data drive chip can be halved, therefore the area and power consumption of the drive chip can be reduced.

Fourth, the yield of the drive chip can be increased through the implementation of a simple drive circuit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A driver circuit for driving an active-matrix display panel, comprising:

a current Digital-to-Analog Converter (CDAC) for generating driving current corresponding to input digital data;

a data line providing said driving current to an array of pixel prepared on the display panel;

an adjacent data line providing a similar or equivalent resistive and capacitive load of said data line;

two driving transistors M1 and M2, wherein the source of the transistor M1 is connected to said data line and the source of the transistor M2 is connected to said adjacent data line;

two current source, wherein the one current source is connected to the source of the transistor M1 and the other current source is connected to the source of the transistor M2;

a current mirror for feeding back transient charging current is generated by the parasitic capacitance of the adjacent data line, as current for charging the data line;

a voltage source VDD connected to the sources of transistor of said current mirror;

a differential amplifier whose output is connected to the gates of the transistor M1 and M2;

a constant voltage $V_{REF}$ connected to the negative input of said differential amplifier;

a node A1 that ties the output of the CDAC, the positive input of the differential amplifier, the output of the current mirror and the drain of the transistor M1;

a node A2 that ties the input of the current mirror and the drain of the transistor M2.

2. The driver circuit as set forth in the claim 1, further comprising a switch which is located between the CDAC and the node A1, and said switch is synchronized by a scan signal.

3. The driver circuit as set forth in the claim 1, further comprising four switches located between a node B1, a node B2 and a display panel, wherein the node B1 is the source terminal side of the drive transistor M1 and the node B2 is the source terminal side of the drive transistor M2, wherein if a scan signal ESCAN is active, the node B1 is connected a even data line EDL and the node B2 is connected a odd data line ODL, wherein if a scan signal OSCAN is active, the node B1 is connected a odd data line ODL and the node B2 is connected a even data line EDL, wherein the scan signal ESCAN and the scan signal OSCAN are not active at the same time.

4. The AMOLED drive circuit as set forth in the claim 1, further comprising a constant current source connected in the data line to charge and discharge the electric capacity;

a data line drive transistor connected to an output node of the current DAC to switch the data line;

compensatory switches which exchange paths of adjacent data lines to remove a mismatching effects, said paths on which the current constant current source and the data line drive transistor are located.

5. The AMOLED drive circuit as set forth in the claim 1, further comprising a switch which is locating between the current DAC and the current mirror unit, and said switch is switched by a logical sum of each scan signal of said data line and the dummy data line.

6. The AMOLED drive circuit as set forth in the claim 1, wherein said data lines are composed of an even data line group and an odd data line group; and further comprising a path switching unit that connects the even data line and the odd data line in order by scan signal of each group for providing the driving current to the even data line and the odd data line in turn.

7. An Active Matrix Organic Light-Emitting Diode (AMOLED) drive circuit using transient current feedback, comprising:

a current Digital-to-Analog Converter (DAC) for generating current corresponding to input digital data;

a data line drive transistor configured such that a drain terminal thereof is connected to an output node of the current DAC;

a constant current source connected between a source terminal of the data line drive transistor and a ground;

a variable current source connected between both an output node of the current DAC and the drain terminal of the drive transistor, and a voltage source;

a differential amplifier configured to input an output voltage thereof to a gate terminal of the drive transistor using a voltage of the output node of the current DAC as an input voltage of a non-inverting input terminal thereof, and using a predetermined constant voltage as an input voltage of an inverting input terminal thereof; and a transient charging current control unit connected between both an output node of the differential amplifier and the gate terminal of the drive transistor, and the variable current source, and configured to increase or decrease bias current of the variable current source depending on variation in the voltage of the output node of the current DAC, wherein the data line drive transistor is for transmitting current from a parasitic capacitance.

8. The AMOLED drive circuit as set forth in claim 7, wherein the transient charging current control unit comprises:

a dummy data line, that is, a data line adjacent to a data line to which pixels, for which data writing is necessary, are connected on a matrix array of a display panel;

a constant current source for functioning as a discharge current source when the dummy data line is discharged;

a transistor configured such that a terminal thereof is connected to the voltage source, thereby forming a current mirror along with the variable current source; and a dummy data line drive transistor configured such that a drain terminal thereof is connected to the transistor and a gate terminal thereof is connected to the differential amplifier, wherein the dummy data line drive transistor is for transmitting current from the parasitic capacitance.

9. The AMOLED drive circuit as set forth in claim 8, further comprising a switch which is configured such that one end thereof is connected to the current DAC, and a remaining end thereof is connected between the current mirror, which is formed of the variable current source and the transistor, and the data line drive transistor, and which is switched in response to a scan signal.

10. The AMOLED drive circuit as set forth in claim 9, wherein the scan signal is a signal generated by an OR operation of a first scan signal, which is a scan signal for a pixel circuit connected to the data line, and a second scan signal, which is a scan signal for a pixel circuit connected to the dummy data line.

11. The AMOLED drive circuit as set forth in claim 8, further comprising a path switching unit located between both output terminals of the data line drive transistor and the dummy data line drive transistor and the display panel, and configured to form current paths for the data line and the dummy data line.

12. The AMOLED drive circuit as set forth in claim 11, wherein the path switching unit comprises a plurality of switches for forming a current path for an even data line, a current path for a dummy data line for the even data line, a current path for an odd data line, and a current path for a dummy data line for the odd data line.

13. The AMOLED drive circuit as set forth in claim 8, further comprising:

a precharge voltage generation transistor for generating data line precharge voltage using dummy data current supplied from the current DAC;

a first precharge switch located between a gate terminal of the precharge voltage generation transistor and the non-inverting input terminal of the differential amplifier, and configured to be turned on during a precharge period of the data line;

a second precharge switch configured such that one end thereof is connected to the inverting input terminal of the differential amplifier and a remaining end thereof is connected to the drain terminal of the data line drive transistor, and configured to turned on during the precharge period of the data line;

a third precharge switch located between the data line and the inverting input terminal of the differential amplifier, and configured to be turned on during the precharge period of the data line;

a first normal driving period switch configured such that one end thereof is connected to the non-inverting input terminal of the differential amplifier and a remaining end thereof is connected to the drain terminal of the data line drive transistor, and configured to be turned on during a normal data driving period of the data line; and a second normal driving period switch configured such that one end thereof is connected to the inverting input terminal of the differential amplifier and a remaining end is connected to the inverting input terminal of the differential amplifier, and configured to be turned on during the normal data driving period of the data line;

wherein an amount of variation in transient voltage of the data line decreases due to generation of precharge voltage, thereby increasing a data driving speed.

14. The AMOLED drive circuit as set forth in claim 13, further comprising a path switching unit located between both output terminals of the data line drive transistor and the dummy data line drive transistor and the display panel, and configured to form current paths for the data line and the dummy data line.

15. The AMOLED drive circuit as set forth in claim 14, wherein the path switching unit comprises a plurality of switches for forming a current path for an even data line, a current path for a dummy data line for the even data line, a current path for an odd data line, and a current path for a dummy data line for the odd data line.

16. The AMOLED drive circuit as set forth in claim 7, wherein the elements are overall formed to have a complementary structure.

17. An AMOLED drive circuit using transient current feedback, comprising:

a current DAC for generating current corresponding to input digital data;

a dummy data line, that is, a data line adjacent to a data line to which pixels, for which data writing is necessary, are connected on a matrix array of a display panel;

a current mirror for feeding back transient charging current, which is generated by a parasitic capacitance of the dummy data line, as data line charging current;

first and second constant current sources for functioning as discharge current sources when the data line and the dummy data line are discharged;

first and second drive transistors connected to the current mirror, and configured to drive the data line and the dummy data line; and a differential amplifier configured to input an output thereof to gate terminals of the first and second drive transistors using a voltage of an output node of the current DAC as a voltage of a non-inverting input terminal thereof, and using a predetermined constant voltage as a voltage of an inverting input terminal thereof.

18. The AMOLED drive circuit as set forth in claim 17, wherein, when data writing to the pixels connected to the first data line is completed, the dummy data line is used as a data line connected to pixels for which data writing is necessary, and the first data line is used as a dummy data line.

19. The AMOLED drive circuit as set forth in claim 17, further comprising a switch which is configured such that one end thereof is connected to the current DAC, and a remaining end thereof is connected between the current mirror and the first data line drive transistor, and which is switched in response to a scan signal.

20. The AMOLED drive circuit as set forth in claim 19, wherein the scan signal is a signal generated by an OR operation of a first scan signal, which is a scan signal for a pixel circuit connected to the data line, and a second scan signal, which is a scan signal for a pixel circuit connected to the dummy data line.

21. The AMOLED drive circuit as set forth in claim 17, further comprising a path switching unit located between both output terminals of the first and second drive transistors and the display panel, and configured to form current paths for the data line and the dummy data line.

22. The AMOLED drive circuit as set forth in claim 21, wherein the path switching unit comprises a plurality of switches for forming a current path for an even data line, a current path for a dummy data line for the even data line, a current path for an odd data line, and a current path for a dummy data line for the odd data line.

23. The AMOLED drive circuit as set forth in claim 17, further comprising:

a precharge voltage generation transistor for generating data line precharge voltage using dummy data current supplied from the current DAC;

a first precharge switch located between a gate terminal of the precharge voltage generation transistor and the non-inverting input terminal of the differential amplifier, and configured to be turned on during a precharge period of the data line;

a second precharge switch configured such that one end thereof is connected to the inverting input terminal of the differential amplifier and a remaining end thereof is connected to a drain terminal of the first drive transistor, and configured to be turned on during the precharge period of the data line;

a third precharge switch located between the data line and the inverting input terminal of the differential amplifier, and configured to be turned on during the precharge period of the data line;

a first normal driving period switch configured such that one end thereof is connected to the non-inverting input terminal of the differential amplifier and a remaining end thereof is connected to a drain terminal of the first drive transistor, and configured to be turned on during a normal data driving period of the data line; and a second normal driving period switch configured such that one end thereof is connected to the inverting input terminal of the differential amplifier and a remaining end is connected to the inverting input terminal of the differential amplifier, and configured to be turned on during the normal data driving period of the data line;

wherein an amount of variation in transient voltage of the data line decreases due to generation of precharge voltage, thereby increasing a data driving speed.

24. The AMOLED drive circuit as set forth in claim 23, further comprising a path switching unit located between both output terminals of the first and second drive transistors and the display panel, and configured to form current paths for the data line and the dummy data line.

25. The AMOLED drive circuit as set forth in claim 24, wherein the path switching unit comprises a plurality of switches for forming a current path for an even data line, a current path for a dummy data line for the even data line, a current path for an odd data line, and a current path for a dummy data line for the odd data line.

26. The AMOLED drive circuit as set forth in claim 17, wherein the elements are overall formed to have a complementary structure.

27. An AMOLED drive circuit using transient current feedback, comprising:

a current DAC for generating current corresponding to input digital data;

a dummy data line, that is, a data line adjacent to a data line to which pixels, for which data writing is necessary, are connected on a matrix array of a display panel;

a current mirror for feeding back transient charging current, which is generated by a parasitic capacitance of the dummy data line, as data line charging current;

constant current sources for functioning as discharge current sources when the data line and the dummy data line are discharged;

first and second drive transistors connected to the current mirror, and configured to drive the data line and the dummy data line;

a differential amplifier configured to input an output thereof to gate terminals of the first and second drive transistors using a voltage of an output node of the current DAC as a voltage of a non-inverting input terminal thereof, and using a predetermined constant voltage as a voltage of an inverting input terminal thereof; and a path switching unit located between both output terminals of the first and second drive transistors and the display panel, and configured to form current paths for the data line and the dummy data line.

28. The AMOLED drive circuit as set forth in claim 27, wherein the current mirror is implemented using a stacked mirror to increase accuracy thereof.

29. The AMOLED drive circuit as set forth in claim 27, wherein the path switching unit comprises a plurality of switches for forming a current path for an even data line, a current path for a dummy data line for the even data line, a current path for an odd data line, and a current path for a dummy data line for the odd data line.

30. The AMOLED drive circuit as set forth in claim 27, wherein the path switching unit comprises:

a first switch located between a source terminal of the first drive transistor and the display panel, and configured to be switched in response to a first scan signal and thus form a current path for an even data line;

a second switch located between a source terminal of the second drive transistor and the display panel, and configured to be switched in response to the first scan signal and thus form a current path for a dummy data line for an even data line;

a third switch located between the source terminal of the first drive transistor and the display panel, and configured to be switched in response to a second scan signal and thus form a current path for the odd data line; and a fourth switch located between the source terminal of the second drive transistor and the display panel, and configured to be switched in response to the second scan signal and thus form a current path for a dummy data line for the odd data line.

31. The AMOLED drive circuit as set forth in claim 27, further comprising a switch which is configured such that one end thereof is connected to the current DAC, and a remaining end thereof is connected between the current mirror and the first data line drive transistor, and which is switched in response to a scan signal.

32. The AMOLED drive circuit as set forth in claim 31, wherein the scan signal is a signal generated by an OR operation of a first scan signal, which is a scan signal for a pixel circuit connected to the data line, and a second scan signal, which is a scan signal for a pixel circuit connected to the dummy data line.

33. The AMOLED drive circuit as set forth in claim 27, further comprising:

a precharge voltage generation transistor for generating data line precharge voltage using dummy data current supplied from the current DAC;

a first precharge switch located between a gate terminal of the precharge voltage generation transistor and the non-inverting input terminal of the differential amplifier, and configured to be turned on during a precharge period of the data line;

a second precharge switch configured such that one end thereof is connected to the inverting input terminal of the differential amplifier and a remaining end thereof is connected to a drain terminal of the first drive transistor, and configured to be turned on during the precharge period of the data line;

a third precharge switch located between the data line and the inverting input terminal of the differential amplifier, and configured to be turned on during the precharge period of the data line;

a first normal driving period switch configured such that one end thereof is connected to the non-inverting input terminal of the differential amplifier and a remaining end thereof is connected to a drain terminal of the first drive transistor, and configured to be turned on during a normal data driving period of the data line; and a second normal driving period switch configured such that one end thereof is connected to the inverting input terminal of the differential amplifier and a remaining end is connected to the inverting input terminal of the differential amplifier, and configured to be turned on during the normal data driving period of the data line;

wherein an amount of variation in transient voltage of the data line decreases due to generation of precharge voltage, thereby increasing a data driving speed.

34. The AMOLED drive circuit as set forth in claim 27, wherein the elements are overall formed to have a complementary structure.

35. A method of forming an active matrix to which the AMOLED drive circuit of claim 24 is applied, comprising:

assigning order to all of columns constituting an array of pixels arranged in M rows and N columns;

dividing the columns into an even column group and an odd column group according to order;

dividing all of rows, which constitute the array, into a first dependent row group and a second dependent row group; and defining pixels, which share the even column group, as the first dependent row group, and defining pixels, which share the odd column group, as the second dependent row group.

36. The method as set forth in claim 35, wherein dummy columns and rows are respectively formed outside outermost rows and columns, wherein the formed dummy columns and rows do not include light-emitting elements.

37. A method of driving an active matrix formed using the method of claim 35, comprising forming a single display frame by sequentially driving all of the pixels that share the even column group, and all of the pixels that share the odd column group.

38. The method as set forth in claim 34, wherein, before data driving for a subsequent row is started after data driving for a predetermined row has been completed, data driving is performed by charging or discharging dummy data lines or data lines with a predetermined voltage.

39. A driver circuit for driving an active-matrix display panel, comprising:

a Current Digital-to-Analog Converter (CDAC) for generating driving current corresponding to input digital data;

a data line providing said driving current to an array of pixel prepared on the display panel;

an adjacent data line providing a similar or equivalent resistive and capacitive load of said data line;

two driving transistors M1-1 and M2-1, wherein the source of the transistor M1-1 is connected to said data line and the source of the transistor M2-1 is connected to said adjacent data line;

two current source, wherein the one current source is connected to the source of the transistor M1-1 and the other current source is connected to the source of the transistor M2-1;

a current mirror for feeding back transient charging current is generated by the parasitic capacitance of the adjacent data line, as current for charging the data line;

a voltage source VDD connected to the two current source;

a differential amplifier whose output is connected to the gates of the transistor M1-1 and M2-1;

a constant voltage $V_{REF}$ connected to the negative input of said differential amplifier;

a node that ties the output of the CDAC, the positive input of the differential amplifier, the output of the current mirror and the drain of the transistor M1-1;

a node that ties the input of the current mirror and the drain of the transistor M2-1.

* * * * *